US008801155B2

(12) United States Patent
Netsu

(10) Patent No.: US 8,801,155 B2
(45) Date of Patent: Aug. 12, 2014

(54) LIQUID DISCHARGE HEAD

(71) Applicant: Canon Kabushiki Kaisha, Tokyo (JP)

(72) Inventor: Hiroshi Netsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/918,259

(22) Filed: Jun. 14, 2013

(65) Prior Publication Data

US 2013/0342616 A1 Dec. 26, 2013

(30) Foreign Application Priority Data

Jun. 22, 2012 (JP) ..... 2012-140701

(51) Int. Cl.
*B41J 2/045* (2006.01)
*B41J 2/14* (2006.01)

(52) U.S. Cl.
USPC ..... 347/71; 347/50

(58) Field of Classification Search
None
See application file for complete search history.

(56) References Cited

U.S. PATENT DOCUMENTS

| | | | | |
|---|---|---|---|---|
| 7,232,207 | B2 * | 6/2007 | Watanabe | 347/69 |
| 7,497,554 | B2 * | 3/2009 | Okuno | 347/50 |
| 8,517,491 | B2 | 8/2013 | Netsu | |
| 2013/0093819 | A1 | 4/2013 | Nakakubo et al. | |
| 2013/0242003 | A1 * | 9/2013 | Suzuki et al. | 347/68 |
| 2013/0342612 | A1 * | 12/2013 | Nakakubo | 347/71 |
| 2013/0342614 | A1 * | 12/2013 | Nakamura et al. | 347/71 |

FOREIGN PATENT DOCUMENTS

JP 2007-168319 A 7/2007

* cited by examiner

*Primary Examiner* — Geoffrey Mruk
(74) *Attorney, Agent, or Firm* — Fitzpatrick, Cella, Harper & Scinto

(57) ABSTRACT

Provided is a liquid discharge head, including a piezoelectric block formed by stacking multiple piezoelectric substrates, each of the multiple piezoelectric substrates including a first main surface and a second main surface and having a first groove and a second groove alternately formed in the first main surface, in which the each of the multiple piezoelectric substrates includes a first in-groove electrode, a first rear surface electrode, a second in-groove electrode, and a second rear surface electrode.

6 Claims, 17 Drawing Sheets

LIQUID DISCHARGE HEAD

BACKGROUND OF THE INVENTION

1. Field of the Invention

The present invention relates to a liquid discharge head including a piezoelectric substrate.

2. Description of the Related Art

A liquid discharge head for discharging ink is generally mounted onto an ink jet recording apparatus for recording an image on a recording medium by discharging the ink. As a mechanism for causing the liquid discharge head to discharge ink, there is known a mechanism using a pressure chamber that is formed of a piezoelectric element and is changeable in volume to be shrinkable. In this mechanism, the pressure chamber shrinks due to the deformation of the piezoelectric element to which a voltage is applied, and thus the ink inside the pressure chamber is discharged from a discharge orifice formed at one end of the pressure chamber. As one liquid discharge head including such a mechanism, there is known a shear mode liquid discharge head. In the shear mode liquid discharge head, one or two inner wall surfaces of the pressure chamber are formed of the piezoelectric element, and the pressure chamber is caused to shrink by shear deformation of the piezoelectric element instead of extension or contraction deformation thereof.

Regarding liquid discharge apparatus for industrial applications or the like, there is a demand for use of high viscosity liquid. In order to discharge high viscosity liquid, a large discharge force is required for the liquid discharge head. To satisfy this demand, there has been proposed a liquid discharge head called a Gould type, in which the pressure chamber is formed of a tubular piezoelectric element having a circular or rectangular sectional shape. In the Gould type liquid discharge head, the piezoelectric element extends or is deformed by contraction in the inward and outward directions (radial direction) about the center of the pressure chamber. In this manner, the pressure chamber expands or shrinks. In the Gould type liquid discharge head, the entire wall surface of the pressure chamber deforms, and this deformation contributes to the ink discharge force. Therefore, as compared to the shear mode liquid discharge head in which one or two wall surfaces are formed of the piezoelectric element, a larger ink jet force can be obtained.

In a Gould type liquid discharge head, in order to obtain a higher resolution, it is necessary to arrange multiple discharge orifices more densely. This involves the necessity of densely arranging pressure chambers corresponding to the discharge orifices, respectively. The method of manufacturing a Gould type liquid discharge head capable of arranging pressure chambers with high density is disclosed in Japanese Patent Application Laid-Open No. 2007-168319.

In the manufacturing method disclosed in Japanese Patent Application Laid-Open No. 2007-168319, first, multiple grooves all extending in the same direction are formed in each of multiple piezoelectric substrates. After that, the multiple piezoelectric substrates are stacked so that the grooves are directed in the same direction, and are cut in a direction orthogonal to the direction of the grooves. The groove part of the cut piezoelectric substrate forms an inner wall surface of the pressure chamber. After that, in order to separate the respective pressure chambers, the piezoelectric substrate present between the pressure chambers is removed to a certain depth. On upper and lower sides of the piezoelectric substrate having the completed pressure chambers, a supply path plate and an ink pool plate, and a printed circuit board and a nozzle plate are respectively connected. In this manner, the liquid discharge head is completed. With this manufacturing method disclosed in Japanese Patent Application Laid-Open No. 2007-168319, the pressure chambers can be arranged in matrix, and hence the pressure chambers can be arranged in high density. Further, with this manufacturing method, because forming a groove in the piezoelectric substrate is better in processing than opening a hole in the piezoelectric substrate, the pressure chambers can be formed with high accuracy.

In the liquid discharge head manufactured by the manufacturing method disclosed in Japanese Patent Application Laid-Open No. 2007-168319, multiple pressure chambers are arranged with space therebetween. Therefore, in particular, when the length (height) of the pressure chambers is increased in order to discharge highly viscous liquid (in order to increase the liquid discharge force), the stiffness of the liquid discharge head is lowered. When the stiffness is lowered, a piezoelectric substrate which forms the pressure chambers may be broken and liquid cannot be discharged therefrom.

Accordingly, an object of the present invention is to provide a liquid discharge head which solves the above-mentioned problem. The liquid discharge head which can endure to repeatedly discharge highly viscous ink irrespective of the length of a unit stack, and includes a unit stack having densely arranged ink discharging portions.

Accordingly, an object of the present invention is to provide a liquid discharge head which can enhance the stiffness of a piezoelectric substrate forming a pressure chamber, and a manufacturing method therefor.

SUMMARY OF THE INVENTION

According to an exemplary embodiment of the present invention, there is provided a liquid discharge head, including a piezoelectric block formed by stacking multiple piezoelectric substrates, each of the multiple piezoelectric substrates including a first main surface and a second main surface and having a first groove and a second groove alternately formed in the first main surface, in which the each of the multiple piezoelectric substrates includes a first in-groove electrode on an inner surface of the first groove, a first rear surface electrode on the second main surface at a location corresponding to the second groove, a second in-groove electrode on an inner surface of the second groove, and a second rear surface electrode on the second main surface at a location corresponding to the first groove, the first rear surface electrode being defined at the same potential as a potential of the first in-groove electrode, the second rear surface electrode being defined at the same potential as a potential of the second in-groove electrode, and in which the first groove forms a pressure chamber having the first in-groove electrode and the first rear surface electrode formed on the inner surface thereof, the pressure chamber including an inlet opening and an outlet opening of liquid and being configured to store the liquid supplied from the inlet opening and discharge the liquid through the outlet opening by deformation of the piezoelectric block by piezoelectric effect, and the second groove forms an opening portion having the second in-groove electrode and the second rear surface electrode formed on the inner surface thereof.

Further features of the present invention will become apparent from the following description of exemplary embodiments with reference to the attached drawings.

DESCRIPTION OF THE EMBODIMENTS (First Embodiment)

(Structure of Liquid Discharge Head)

Figure 1A:
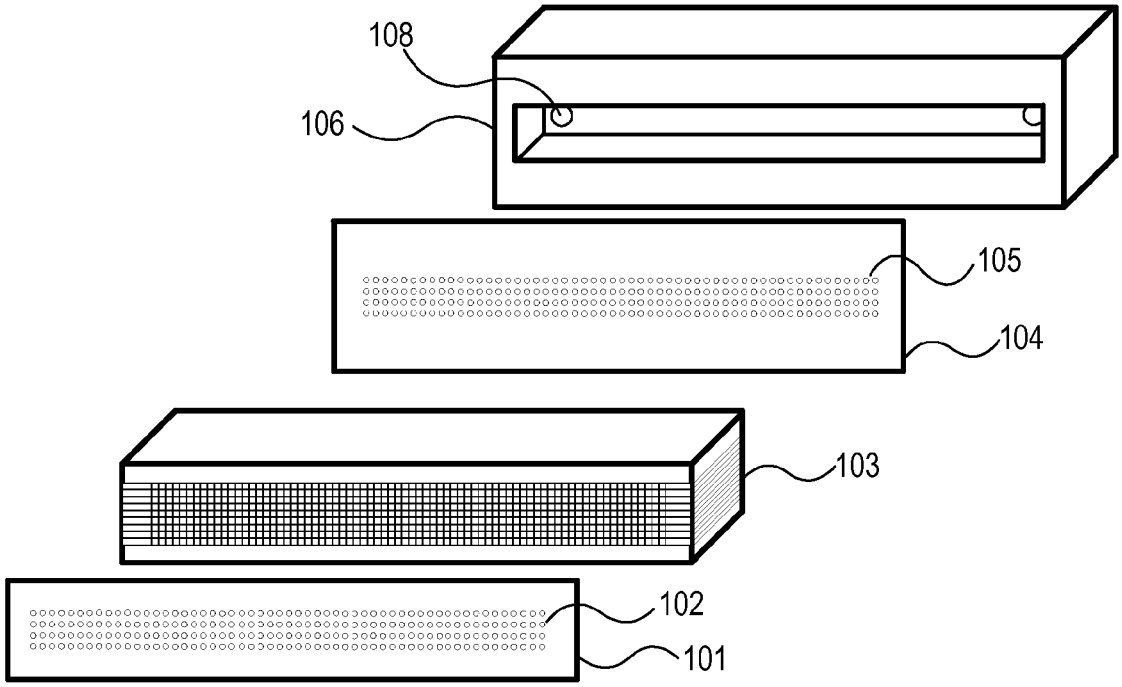
FIGS. 1A and 1B are structural views of an entire liquid discharge head according to a first embodiment of the present invention.
Figure 1B:
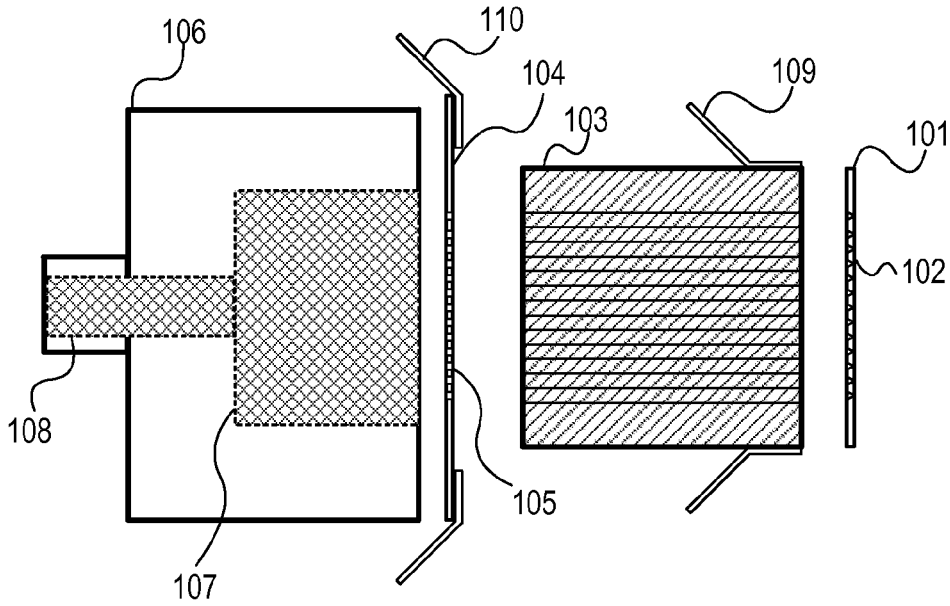

FIGS. 1A and 1B are a perspective view and a side view, respectively, illustrating an entire structure of a liquid discharge head according to a first embodiment of the present invention. For the sake of easy understanding of the structure, an exploded state is illustrated. Nozzle holes 102 through which liquid is discharged are formed in an orifice plate 101 formed of silicon, a polyimide, or the like. A piezoelectric block 103 is formed by stacking multiple piezoelectric substrates having grooves machined therein. The piezoelectric block 103 includes pressure chambers in which electrodes are formed and which are filled with liquid, and opening portions in which electrodes are formed. In order to lead common electrodes in the piezoelectric block 103, the piezoelectric block 103 includes a common electrode wiring cable 109 such as an FPC. A rear throttle plate 104 is a silicon substrate or the like, and has throttle holes 105 formed therein for preventing escape of pressure generated in the pressure chambers to the common liquid chamber side and has wiring formed thereon for leading individual electrodes on inner walls of the pressure chambers. Individual electrode wiring cables 110 such as FPCs are connected to the wiring for leading the individual electrodes formed on the rear throttle plate 104. Liquid 107 is supplied from an ink supply port 108 to a common liquid chamber 106.

Figure 2:
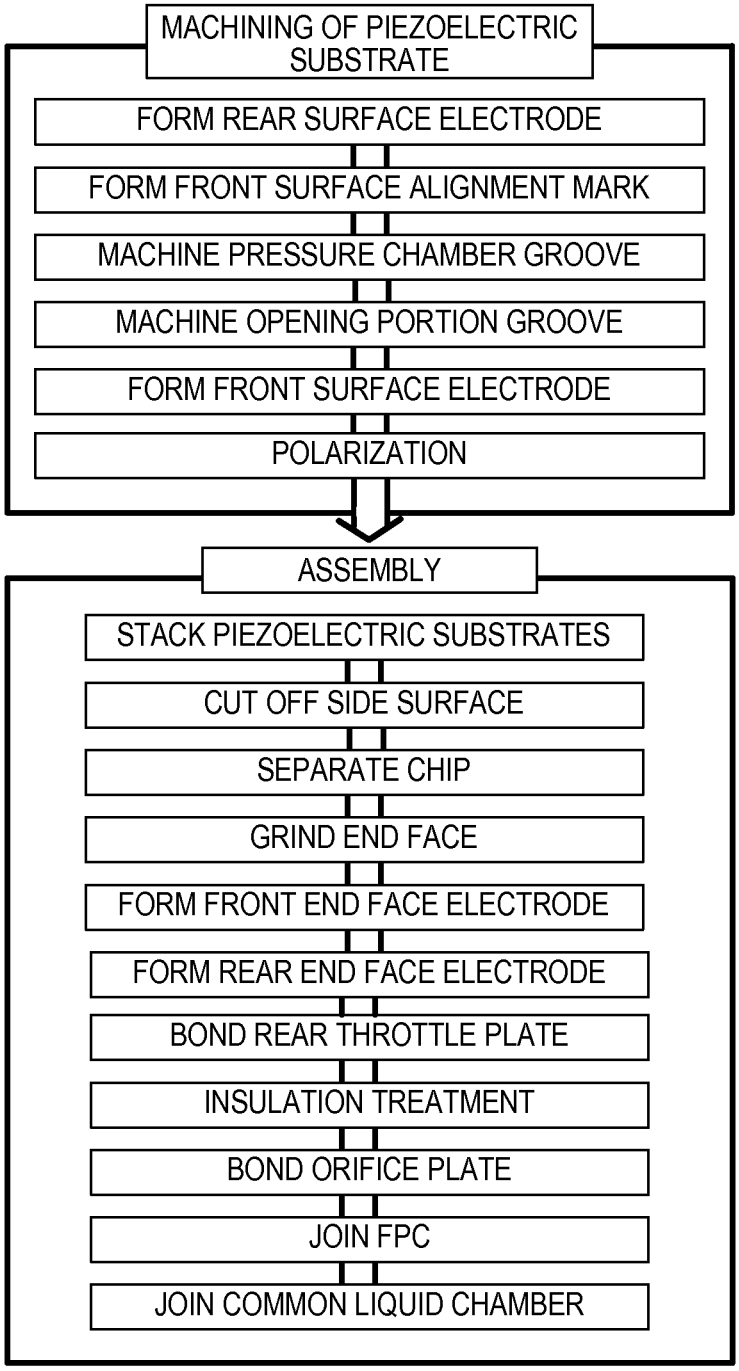
FIG. 2 is a flow chart illustrating manufacturing steps of the liquid discharge head.

A method of manufacturing the liquid discharge head according to this embodiment is described in the following. A flow chart of FIG. 2 illustrates an overview of the manufacturing method. In this embodiment, a liquid discharge head having a resolution corresponding to 1,200 dpi is described by way of example. However, when the resolution is different, by changing the dimensions of the grooves and the number of the stacked piezoelectric substrates, such a liquid discharge head can be manufactured through similar steps.

(Structure of Piezoelectric Block)

In the liquid discharge head according to this embodiment, the nozzle holes 102 are staggered and two-dimensionally arranged. The liquid discharge head forms an image on a recording medium which is transferred in a direction in which the piezoelectric substrates are stacked.

Figure 3A:
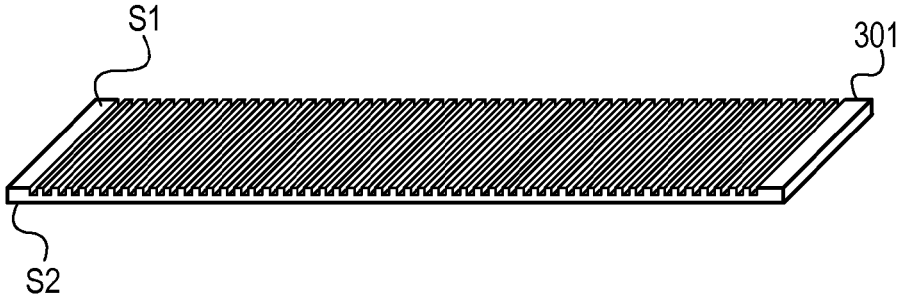
FIGS. 3A, 3B and 3C illustrate the structure of a piezoelectric substrate.
Figure 3B:
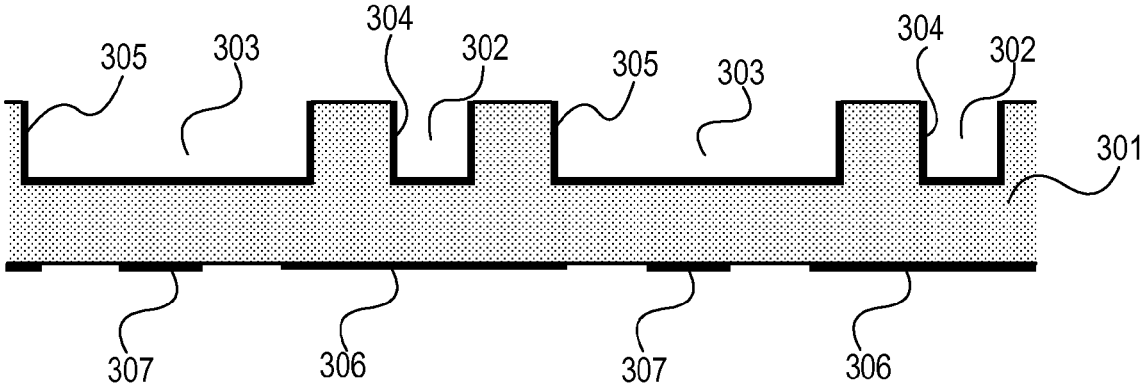
Figure 3C:
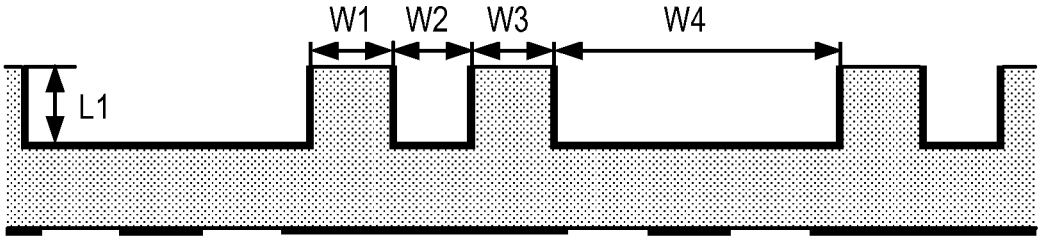

FIGS. 3A to 3C are explanatory diagrams of a piezoelectric substrate 301 which forms the piezoelectric block 103. As illustrated in FIG. 3A, the piezoelectric substrate 301 is a piezoelectric plate having a first main surface S1 and a second main surface S2. A large number of first grooves 302 and second grooves 303 are alternately formed in the first main surface S1. The first groove 302 forms a pressure chamber 701, while the second groove 303 forms an opening portion 702.

FIG. 3B is a sectional view illustrating the shapes of the grooves and the electrodes in the piezoelectric substrate 301. Strip-like electrodes are formed in parallel with the grooves on inner surfaces of the grooves and on a side opposite to the side where the grooves are machined. Specifically, an individual electrode 304 (first in-groove electrode) is formed on inner surfaces of the first groove 302 which forms the pressure chamber 701, and an individual electrode 307 (first rear surface electrode) is formed on the second main surface S2 at a location corresponding to a second groove 303. The individual electrode 307 is defined to be at the same potential as that of the individual electrode 304. A common electrode 305 (second in-groove electrode) is formed on inner surfaces of the second groove 303, and a common electrode 306 (second rear surface electrode) is formed on the second main surface S2 at a location corresponding to the first groove 302. The common electrode 305 is defined to be at the same potential as that of the common electrode 306.

FIG. 3C illustrates dimensions of portions of the piezoelectric substrate 301 according to this embodiment. The most suitable shape in section of the pressure chamber and the thickness of side walls of a piezoelectric body around the pressure chamber are determined by simulation in accordance with the characteristics of the liquid to be discharged, and the dimensions of the portions are determined so as to realize the most suitable shape and thickness. The thickness of the piezoelectric substrate 301 is about 0.24 mm, and a depth L1 of the grooves, a width W2 of the first grooves 302 forming the pressure chambers 701, and thicknesses W1 and W3 of the side walls around the pressure chambers 701 are all 0.12 mm.

Intervals between the first grooves 302 forming the pressure chambers are the dimension of a recording dot grid of 21.2 μm corresponding to a resolution of 1,200 dpi multiplied by n (n is an integer). By stacking n piezoelectric substrates 301 in succession with adjacent piezoelectric substrates 301 being shifted by the grid dimension, a necessary resolution can be realized.

When a width W4 of the second grooves 303 forming the opening portions is increased, crosstalk between the pressure chambers reduces, but the number of the stacked piezoelectric substrates for obtaining a necessary resolution increases. When the width W4 is reduced, the number of the stacked piezoelectric substrates for obtaining a necessary resolution decreases, but crosstalk increases. In the structure according to this embodiment, when n is equal to or larger than 35, a dimension W1+W2+W3 which is a total of a pressure chamber 701 and the piezoelectric side walls on both sides thereof of a piezoelectric substrate is smaller than the dimension W4 of opening portions 702 of piezoelectric substrates 301 vertically (in the direction in which the piezoelectric substrates are stacked) adjacent to the piezoelectric substrate 301, and is within the dimension of the width W4. In this embodiment, the width W4 of the second grooves 303 is set to be further larger and n=37 holds.

It is enough that n is an integer, but, piezoelectric substrates 301 stacked over and under the second grooves 303 are shifted by the recording dot grid dimension. By setting n to be an odd number rather than an even number, the shift between the opening portions and the pressure chambers in the vertically stacked piezoelectric substrates is regular, which is preferred. n=37 and W1 , W2 , and W3 are all 0.12 mm, and thus, W4=0.0212×37−W1−W2−W3=0.4244 mm holds.

(Machining of Piezoelectric Substrate 301)

FIGS. 4A to 4F are perspective views illustrating steps of machining the grooves in and forming electrodes on the piezoelectric substrate 301. For the sake of easy understanding, the width and the intervals of the grooves and the width and the intervals of the electrodes are enlarged to be several times as large as the actual dimensions. As the piezoelectric substrate 301, for example, a lead zirconate titanate (PZT) substrate of 57 mm×74 mm×about 0.24 mm can be used.

(Formation of Rear Surface Electrodes)

Figure 4A:
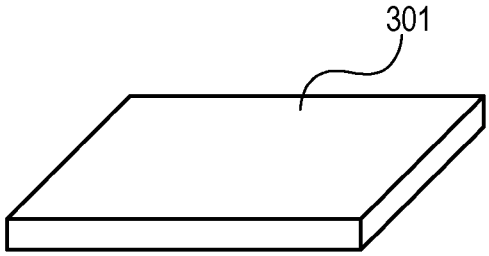
FIGS. 4A, 4B, 4C, 4D, 4E and 4F illustrate steps of machining the piezoelectric substrate.

First, in a step illustrated in FIG. 4A, the flat plate-like piezoelectric substrate 301 having a desired thickness and a desired shape is prepared.

Figure 4D:
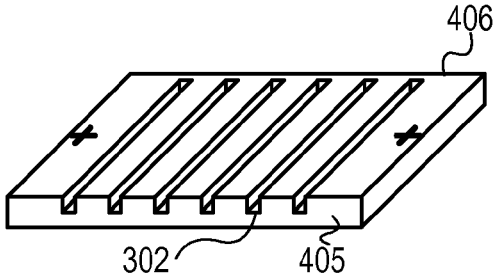
Figure 4B:
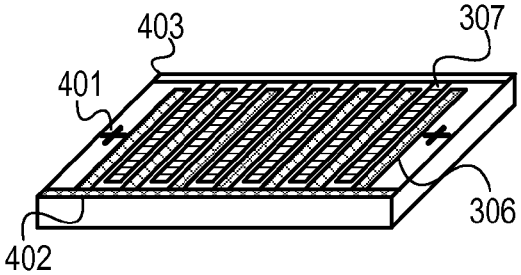

In a step illustrated in FIG. 4B, rear surface alignment marks 401 formed of a metal film, the individual electrodes 307, and the common electrodes 306 are formed at the same time on the second main surface S2 (rear surface) of the piezoelectric substrate 301. The patterns of the individual electrodes 307 and the common electrodes 306 are formed in parallel with the longitudinal direction of the grooves formed in the first main surface S1 (front surface). Further, voltage is applied to all the electrodes in polarization treatment, and thus, all the common electrodes 306 are connected to an end electrode 402, and all the individual electrodes 307 are connected to another end electrode 403 on the opposite side.

The rear surface alignment marks 401 and both electrodes can be patterned by lift-off or etching of a photo resist that uses photolithography, or by removing an unnecessary part with the use of a laser, or through dicing or milling. In this step, the surface of the substrate is flat, and thus, a uniform resist film can be formed even by applying a resist by ordinary spin coating.

Then, the resist is patterned by exposure and development. The resist is patterned by photolithography so that the resist is left by lift-off on portions on which the electrode pattern is not to be formed. Then, a metal layer to be the electrodes is formed on the entire surface including portions on the resist pattern by vapor deposition. Vapor deposition is excellent in easiness of patterning by lift-off. Then, by removing the resist, the metal film formed over the resist is separated together with the resist to finally obtain a desired metal film pattern.

In order to form the electrodes, as an underlayer, a Cr film at a thickness of about 20 nm is formed, and further, a Pd film at a thickness of about 50 nm is formed, and patterning is carried out. Further, an Ni plating layer at a thickness of about 1,000 nm is formed with the Pd film used as a seed layer, and displacement plating of Au on Ni on the surface is carried out. In the method using plating, the film thickness is small in lift-off, and thus, burrs are less liable to be formed to improve the patterning. In addition, Au is used only on the surface, and thus, the cost is reduced.

(Formation of Front Surface Alignment Marks)

Figure 4E:
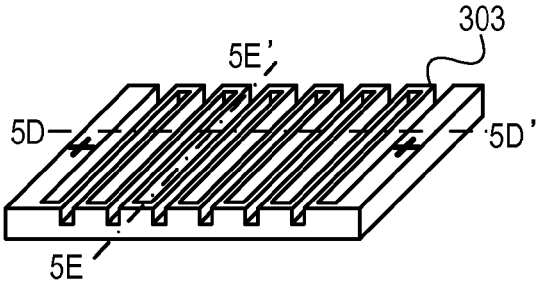
Figure 4C:
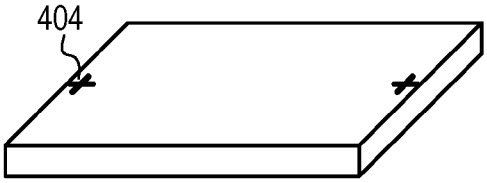

In a step illustrated in FIG. 4C, grooves are machined in the groove formation surface (first main surface S1) of the piezoelectric substrate 301, and front surface alignment marks 404 are formed. The front surface alignment marks 404 are formed of a metal film, and are used in alignment when the grooves are machined and when the piezoelectric substrates are stacked. The method of carrying out patterning and the method of forming the metal film are the same as those with regard to the individual electrodes 307 and the common electrodes 306.

(Machining of Pressure Chamber Grooves)

The grooves are machined while being positioned with reference to the front surface alignment marks 404 formed in the previous step. Specifically, in a step illustrated in FIG. 4D, the multiple first grooves 302 are formed in the flat plate-like piezoelectric substrate 301. A part of the formed first grooves 302 forms the pressure chambers. In this embodiment, when cutting is carried out, by raising a super abrasive wheel in its track on the piezoelectric substrate, a groove which does not communicate to one side surface is formed. As illustrated in FIG. 4D, the first grooves 302 communicate to a first end face 405 and do not communicate to a second end face 406. By forming, in addition to grooves to be the pressure chambers, grooves on both sides thereof, the grooves on both sides can function as escape grooves for an adhesive in a subsequent joining step (not shown in FIGS. 4A to 4F).

(Machining of Opening Portion Grooves)

In a step illustrated in FIG. 4E, the multiple second grooves 303 are formed in the piezoelectric substrate 301 having the first grooves 302 formed therein. A part of the formed second grooves 303 forms the above-mentioned opening portions. A second groove 303 is formed between first grooves 302. With regard to the second grooves 303, also, when cutting is carried out, by raising a super abrasive wheel in its track on the piezoelectric substrate, a groove which does not communicate to one side surface is formed. As illustrated in FIG. 4E, the second grooves 303 communicate to the second end face 406 and do not communicate to the first end face 405.

(Formation of Front Surface Electrodes)

Figure 4F:
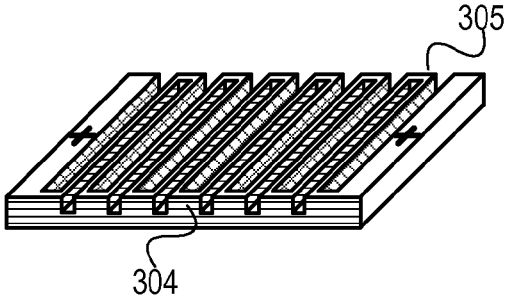

In a step illustrated in FIG. 4F, the individual electrodes 304 are formed on the inner surfaces of the formed first grooves 302, and the common electrodes 305 are formed on the inner surfaces of the formed second grooves 303. The electrodes can be patterned by lift-off, a laser, grinding, or the like. By way of example, FIGS. 5A to 5E illustrate a method of patterning the electrodes by lift-off. FIGS. 5A to 5D are sectional views taken along the line A-A' of FIG. 4E, and FIG. 5E is a sectional view taken along the line B-B' of FIG. 4E. The surface of the substrate is uneven by the machining of the grooves, and thus, it is difficult to form a uniform resist film by application using an ordinary spin coater. Therefore, lamination of a film resist or application using a spray coater is suitably used. It is difficult to uniformly expose the inside of the grooves, and thus, it is preferred to use a negative type resist which requires exposure of only the outside of the groove.

Figure 5A:
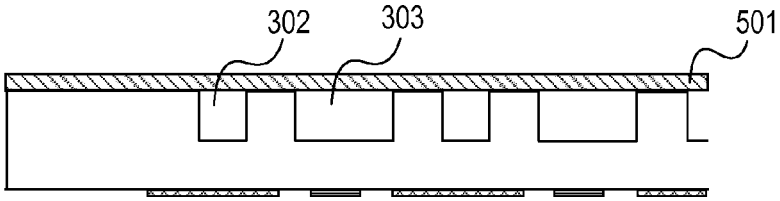
FIGS. 5A, 5B, 5C, 5D and 5E illustrate formation of electrodes by lift-off.

First, in a step illustrated in FIG. 5A, a film resist 501 is laminated. The piezoelectric substrate 301 is a sintered body, and thus, includes voids of about 10 μm scattered therein. Therefore, if the film resist 501 is too thin, pattern losses are caused in portions of the film over the voids. It is thus preferred that the film resist 501 which is used have a sufficient thickness of, for example, 40 μm or more.

Figure 5B:
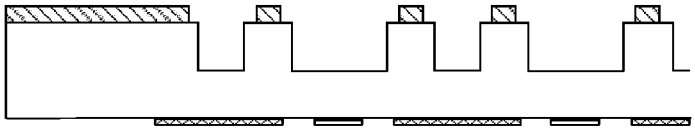

Then, in a step illustrated in FIG. 5B, the film resist 501 is patterned by exposure and development. The resist pattern is formed by photolithography so that the resist is left by lift-off on portions on which the electrode pattern is not to be formed. It is preferred that, at this time, the width of the resist pattern be smaller than the width of the side walls of the grooves so that a metal layer is formed over the entire area of the side walls of the grooves in the subsequent step. For example, when the width of the side walls is 0.12 mm, the width of the resist pattern is 0.06 mm.

Figure 5C:
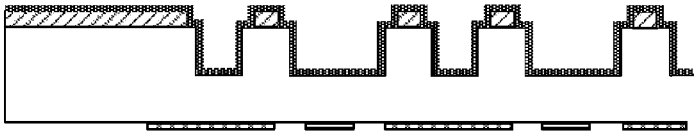

In a step illustrated in FIG. 5C, a metal layer to be the electrodes is formed on the entire surface including portions on the resist pattern by sputtering or vapor deposition. Sputtering is excellent in film formation on the side walls of the grooves, and vapor deposition is excellent in easiness of patterning by lift-off.

Figure 5D:
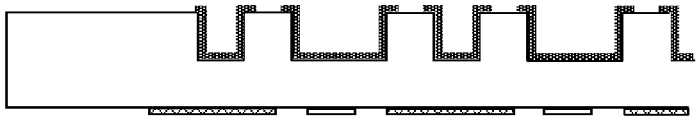
Figure 5E:
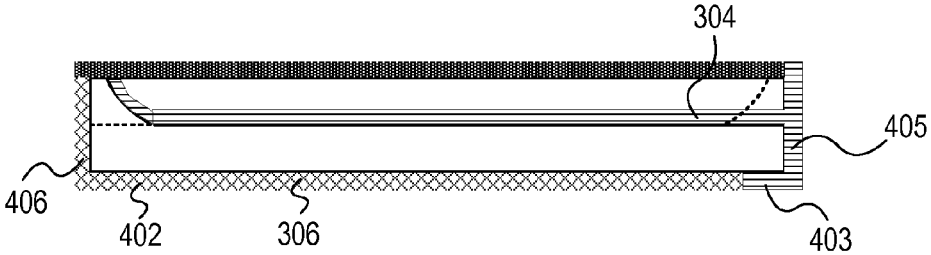

Then, by removing the resist in a step illustrated in FIG. 5D, the metal film formed over the resist is separated together with the resist to finally obtain a desired metal film pattern. As an underlayer of the electrodes, for example, a Cr film at a thickness of about 20 nm can be formed, and further, as an electrode layer, an Au film at a thickness of about 1,000 nm can be formed. Alternatively, as an underlayer, a Cr film at a thickness of about 20 nm and a Pd film at a thickness of about 50 nm can be formed, and patterning can be carried out, and further, an Ni plating layer at a thickness of about 1,000 nm can be formed with the Pd film used as a seed layer, and then displacement plating of Au on Ni on the surface can be carried out. In particular, in the latter method using plating, the film thickness is small in lift-off, and thus, burrs are less liable to be formed to improve the patterning. In addition, Au is used only on the surface, and thus, the cost is reduced.

When a laser or grinding is used, first, the metal film is formed on the entire surface by sputtering, vapor deposition, electroless plating, or the like. Then, by removing by a laser or grinding unnecessary portions of the formed metal film, that is, portions of the metal film over the portions in which the grooves are formed, the desired electrode pattern is obtained.

All the individual electrodes 304 and all the individual electrodes 307 are electrically connected via a metal film formed on the first end face 405. Further, all the common electrodes 305 and all the common electrodes 306 are electrically connected via a metal film formed on the second end face 406.

(Polarization)

Figure 6A:
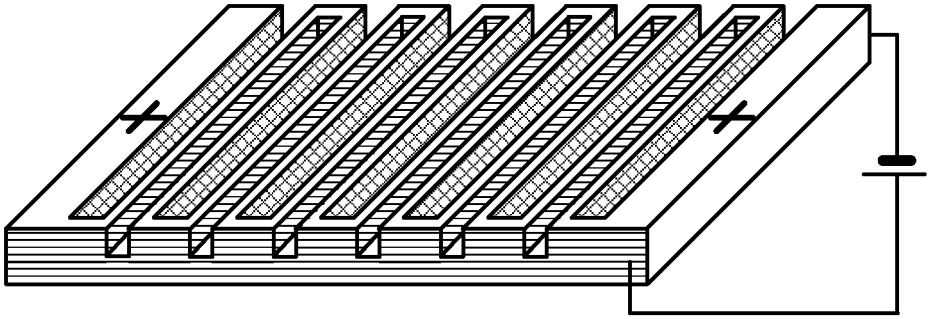
FIGS. 6A and 6B illustrate polarization treatment of the piezoelectric substrate.
Figure 6B:
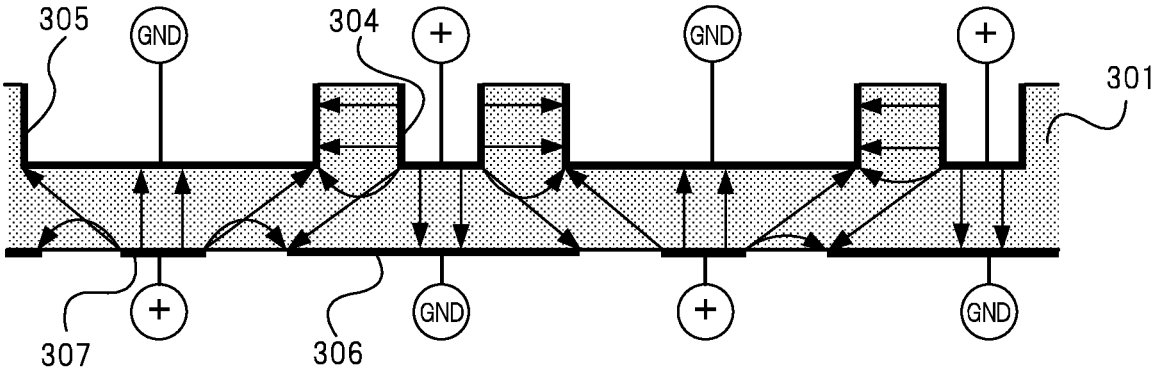

By setting the common electrodes 305 and 306 to be at a ground potential and applying a positive voltage to the individual electrodes 304 and 307 as illustrated in FIG. 6A, polarization treatment is applied to the piezoelectric substrate 301. FIG. 6B illustrates an electric field applied to the piezoelectric substrate 301. The polarization is carried out by applying for a predetermined time period a high electric field of about 1 to 2 kV/mm to the piezoelectric body in a state of being heated to about 100 to 150° C.

The intervals of the electrodes on the side walls are as small as 0.06 mm, and thus, when the high electric field of 1 to 2 kV/mm is applied in the air, there is a high probability that air discharge or creeping discharge occurs. Therefore, it is desired that the polarization treatment be performed in a highly insulating oil such as silicone oil (dielectric breakdown voltage: 10 kV/mm or more). After the polarization, the silicone oil can be removed by a hydrocarbon-based solvent such as xylene, benzene, or toluene, or by a chlorinated hydrocarbon-based solvent such as methylene chloride, 1.1.1-trichloroethane, or chlorobenzene.

After the polarization, as necessary, aging treatment is performed. Specifically, by keeping the piezoelectric substrate 301 after the polarization treatment for a predetermined time period in a state in which the temperature is raised, the piezoelectric characteristics of the piezoelectric substrate 301 is stabilized. The aging is carried out by, for example, leaving the piezoelectric substrate 301 after the polarization treatment in an oven at 100° C. for 10 hours.

(Assembly)

Figure 7A:
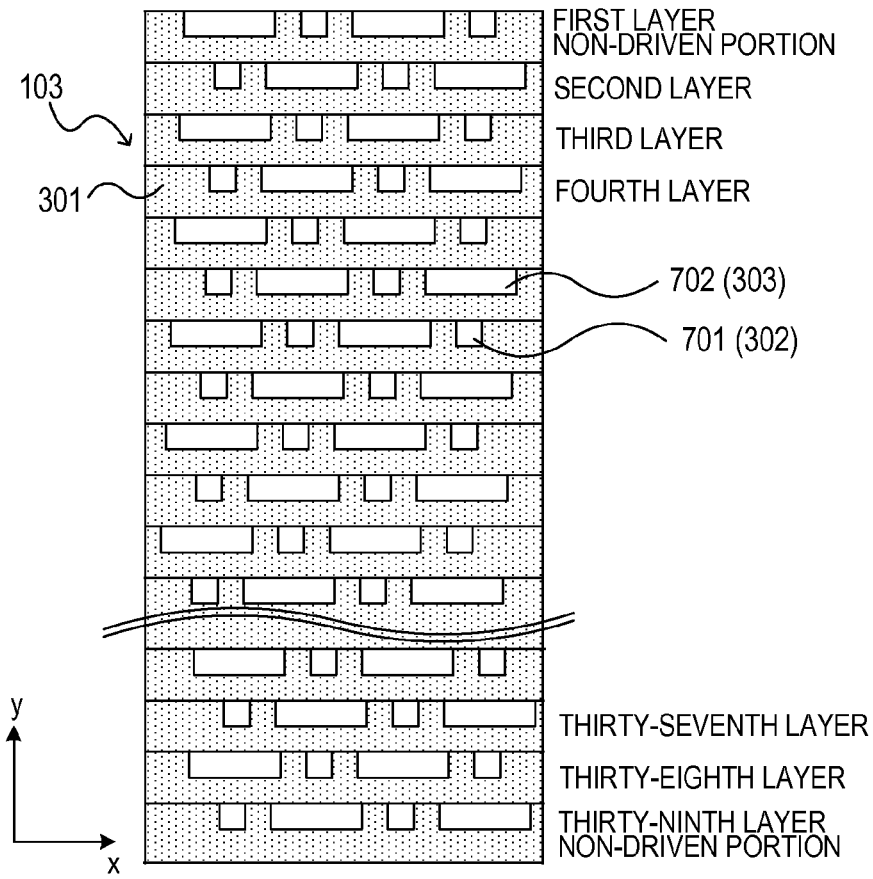
FIGS. 7A and 7B are structural views of a piezoelectric block in which the piezoelectric substrates are stacked.

Multiple, in this case, as illustrated in FIG. 7A, n+2=39, piezoelectric substrates 301 machined as described above are stacked to form the piezoelectric block 103. In order to enhance the mechanical strength of the piezoelectric block 103, it is preferred that a piezoelectric body or ceramic reinforcing plate (not shown) at a thickness of about 1 to 5 mm be joined to the upper surface and the lower surface of the stack of the piezoelectric substrates 301. The piezoelectric block 103 is polarized in a direction which passes through the pressure chambers and the opening portions around the pressure chambers.

Figure 7B:
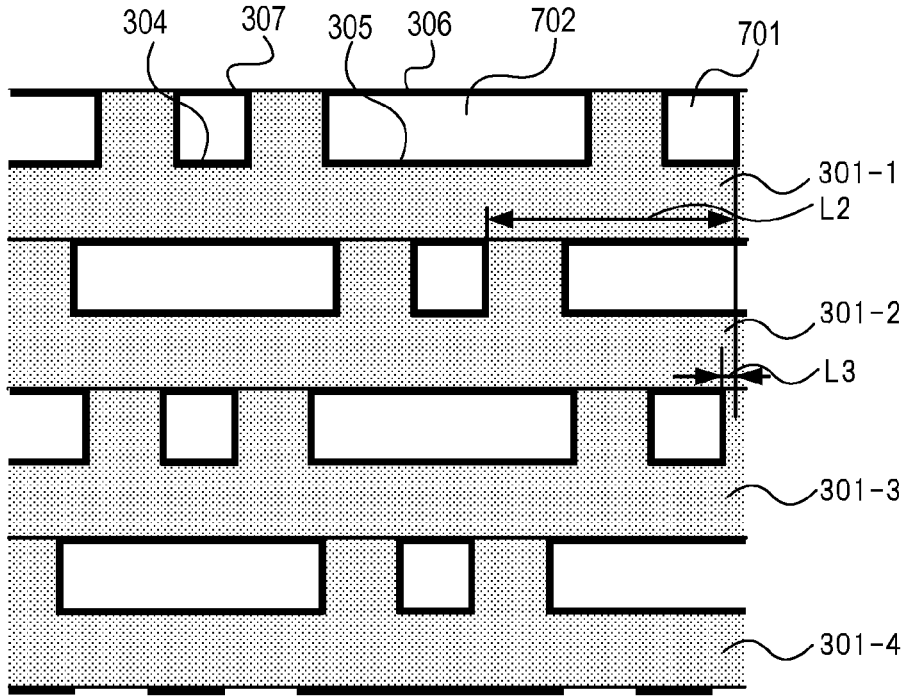

Positional relationship when the piezoelectric substrates 301 are joined together and positional relationship between the pressure chambers 701 and the opening portions 702 which are formed by the joining are described in detail with reference to FIG. 7B. Generally, when a liquid discharge head is formed by stacking n piezoelectric substrates 301 under a state in which the pitches of the first grooves 302 in an x direction are the recording dot grid dimension multiplied by n, the following is satisfied. The first grooves 302 in the piezoelectric substrate 301 adjacent to a starting piezoelectric substrate 301 in a y direction is shifted in the x direction by the recording dot grid dimension multiplied by m, where n and m are coprime natural numbers, and m is the number which is closest to ½ of n among numbers which satisfy the above-mentioned condition. In this manner, the first grooves 302 in the starting piezoelectric substrate 301 are positioned around the centers of the second grooves 303 of the piezoelectric substrate 301 adjacent to the starting piezoelectric substrate 301 in the y direction, respectively.

With reference to a piezoelectric substrate 301-1, a piezoelectric substrate 301-2 immediately therebelow is bonded thereto in a state of being shifted by L2, and a piezoelectric substrate 301-3 immediately below the piezoelectric substrate 301-2 is bonded to the piezoelectric substrate 301-2 in a state of being shifted by L3. Then, with reference to the piezoelectric substrate 301-3 immediately below the piezoelectric substrate 301-2, a piezoelectric substrate 301-4 immediately therebelow is bonded thereto in a state of being shifted by L2. In this way, the piezoelectric substrates are stacked in a state of being shifted with reference to every third piezoelectric substrate. According to this embodiment, L2=21.2×(n/2+0.5)=402.8 μm holds, and L3 is the recording dot grid dimension of 21.2 μm.

(Stacking of Piezoelectric Substrates)

In joining the piezoelectric substrates 301 together, for example, an epoxy-based adhesive can be used. In this case, in order to prevent the grooves from being filled with the adhesive, the amount of the adhesive is required to be appropriately controlled. With regard to the method of applying the adhesive, by forming a thin uniform adhesive layer by spin coating or screen printing on another flat substrate, pressing the surface to be bonded against the adhesive layer, and then separating the adhesive layer from the flat substrate, a thin uniform adhesive layer can be formed on the piezoelectric substrate. After the adhesive is applied, the piezoelectric substrates 301 are positioned with a small space therebetween, and then, are pressurized to be bonded together. As a rough indication of the thickness of the adhesive, it is appropriate that the thickness of the adhesive layer before the bonding be about 4 μm and the thickness of the adhesive layer after the bonding be about 2 μm.

In order to inhibit entrance of the adhesive into the pressure chambers 701 and the opening portions 702, it is effective to form grooves outside multiple lines of the first grooves 302 and outside multiple lines of the second grooves 303 to be used as escape grooves for the adhesive.

In the stacking, alignment is made using a camera. As marks used in the alignment, the edges of the chips, the grooves, the rear surface alignment marks and the front surface alignment marks patterned when the electrodes are formed, or the like can be used. By stacking and joining together the multiple piezoelectric substrates 301 and joining reinforcing plates so as to sandwich the multiple piezoelectric substrates 301 as described above, the piezoelectric block 103 is formed. The reinforcing plates are not required to be formed of a piezoelectric body, but, when heating is required in the joining, it is desired that the reinforcing plates be formed of a material having the thermal expansion coefficient close to that of the piezoelectric substrates 301.

By stacking the piezoelectric substrates 301, a rear surface of a bottom portion of a second groove 303 which forms an opening portion is joined over a first groove 302 to form a closed pressure chamber 701, and individual electrodes 304 and 307 are formed on inner surfaces thereof. A rear surface of a bottom portion of a first groove 302 which forms a pressure chamber is joined over a second groove 303 to form a closed opening portion 702, and common electrodes 305 and 306 are formed on inner surfaces thereof. The individual electrodes 304 and 307 are electrically connected via the wiring portion at the end of the piezoelectric block 103, and are not necessarily electrically connected by this joining. Therefore, it is not necessary that the width of an individual electrode 307 and the width of a first groove 302 be the same. The width of an individual electrode 307 may be smaller than the width of a first groove 302 to some extent, but, taking into consideration misalignment in the bonding and the like, it is preferred that the width of the individual electrode 307 be larger. Similarly, the width of a common electrode 306 may be smaller than the width of a second groove 303 to some extent, but, taking into consideration misalignment in the bonding and the like, it is preferred that the width of a common electrode 306 be larger.

The piezoelectric substrate 301 in the uppermost first layer is necessary in order to join a rear surface of a bottom portion of a second groove 303 thereof over a first groove 302 which forms a pressure chamber in the second layer to form a closed pressure chamber 701. Therefore, no drive voltage is applied to the individual electrodes 304 in the first grooves 302 in the first layer, and thus, no liquid droplet is discharged from the pressure chambers 701 in this layer. Further, the piezoelectric substrate 301 in the lowermost thirty-ninth layer is necessary in order to form an opening portion 702 under a pressure chamber 701 in the thirty-eighth layer, but is not required to be formed of a piezoelectric body, and may be a reinforcing plate having the second grooves 303 which form the opening portions formed therein.

(Cutoff of Side Surface)

Figure 8:
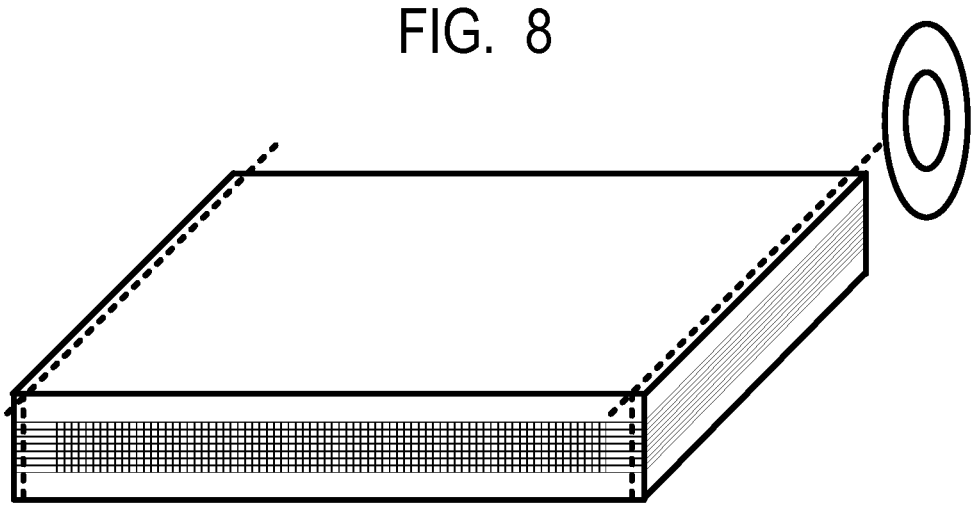
FIG. 8 is an explanatory diagram of a method of cutting off both ends of the piezoelectric block.

As described above, the piezoelectric block 103 is formed by stacking the piezoelectric substrates 301 in a state of being shifted, and thus, the side surfaces thereof are not flat. Therefore, in order to flatten the side surfaces, the both ends are cut off as illustrated in FIG. 8. As the cutoff method, cutting is generally used.

(Separation of Chips)

Figure 9:
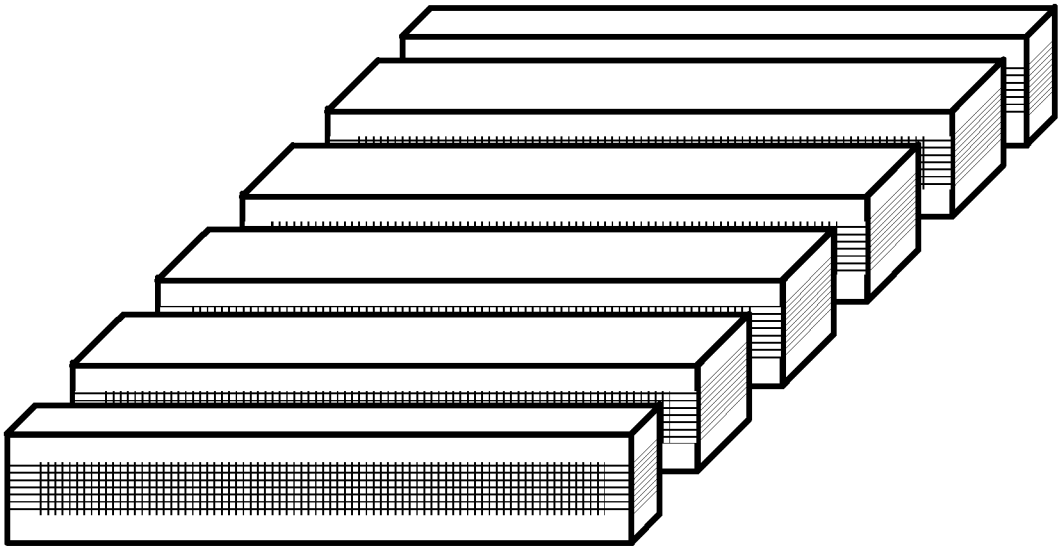
FIG. 9 is an explanatory diagram of a method of dividing the piezoelectric block into chips.

After the both ends of the piezoelectric block 103 are cut off, as illustrated in FIG. 9, the piezoelectric block 103 is divided into multiple chips each having pressure chambers at a necessary length. As the dividing method, cutting is generally used. As the length of the pressure chambers becomes larger, volume change of the pressure chambers when a drive voltage is applied thereto becomes larger to increase the discharge force, but the responsivity of pressure with respect to drive voltage waveform is lowered. Therefore, depending on the viscosity of the liquid to be discharged and the amount of a liquid droplet to be discharged, the optimum value is determined. According to this embodiment, the discharge force is a high priority, and the piezoelectric block 103 is divided so that the length of the pressure chambers is 10 mm. The both ends of about 8 mm are discarded. When the viscosity of the liquid is not so high and a small liquid droplet is discharged, it is preferred that the length of the pressure chambers be as small as 2 to 5 mm.

By discarding the both ends, the end electrode 403 which has connected the individual electrodes on the rear surface for the polarization, the metal film formed on the first end face 405, and the non-groove portions formed by raising the super abrasive wheel in its track when the first grooves 302 are formed are cut off. Similarly, the end electrode 402 which has connected the common electrodes on the rear surface, the metal film formed on the second end face 406, and the non-groove portions formed by raising the super abrasive wheel in its track when the second grooves 303 are formed are cut off. This causes the pressure chambers 701 and the opening portions 702 to be through holes which open at both ends of the piezoelectric block 103. At this stage, the pressure chambers having the first in-groove electrodes and the first rear surface electrodes formed on the inner surfaces thereof and including inlet openings and outlet openings of the liquid are formed. Similarly, the opening portions having the second in-groove electrodes and the second rear surface electrodes formed on the inner surfaces thereof are formed.

(Grinding of End Faces)

The both end faces on which the pressure chambers 701 and the opening portions 702 of the piezoelectric block 103 are exposed are flattened by grinding. A grindstone may be used in the grinding. Taking into consideration the subsequent steps of forming electrodes, it is preferred that, with regard to the surface roughness, an arithmetic mean roughness Ra be about 0.4 μm. Further, in order to bond the orifice plate 101 and the rear throttle plate 104 with high accuracy, it is preferred that the flatness of each end face be 10 μm or less and the parallelism between the end faces be 30 μm or less.

(Formation of Front End Face Electrode)

Next, electrodes for leading wiring of the common electrodes 305 and 306 provided in the opening portions 702 are formed on a front end face 711 of the piezoelectric block 103. FIG. 10 illustrates front end face electrodes 712 for leading the wiring. The front end face electrode 712 is routed from the front end face 711 to an upper end face 713 and a lower end face 714 of the piezoelectric block 103, and, in a step described later, is connected to the common electrode wiring cables 109 at common electrode connecting portions 715 and 716.

Patterning of the front end face electrode 712 is now described. The front end face 711 includes the pressure chambers 701, the opening portions 702, and the like, and is thus uneven. Therefore, when the electrodes are patterned, similarly to the case in which the electrodes are formed on the surfaces of the piezoelectric substrate 301, lamination of a film resist is used. As the film, a negative type resist is used. The resist pattern is formed by photolithography so that the resist is left by lift-off on portions on which the electrode pattern is not to be formed. A metal layer to be the electrodes is formed on the entire surface including portions on the resist pattern by sputtering or vapor deposition. Then, by removing the resist, the metal film formed over the resist is separated together with the resist to finally obtain a desired metal film pattern.

First, after a film resist is laminated on the front end face 711 of the piezoelectric block 103, the opening portions 702 and portions therearound are exposed by exposure and development. At that time, the pressure chambers 701 and portions therearound are covered with the resist. Then, by removing the resist, lift-off is carried out, and the electrodes can be formed in a desired pattern. Further, an electrode layer is formed, and the electrode layer is electrically connected to the common electrodes in the opening portions 702. At this time, by carrying out the film formation with a mask being also formed on the upper end face 713 and the lower end face 714, the common electrode connecting portions 715 and 716 to be connecting portions to the common electrode wiring cables 109 can be formed.

Space of about 1 to 2 μm due to the adhesive layer exists between the piezoelectric substrates. However, similarly to the case in which the surface electrodes are formed on the piezoelectric substrate 301, by forming an underlayer and applying plating treatment, a thickness which is large enough to obtain electrical connection despite the unevenness can be obtained.

Figure 10A:
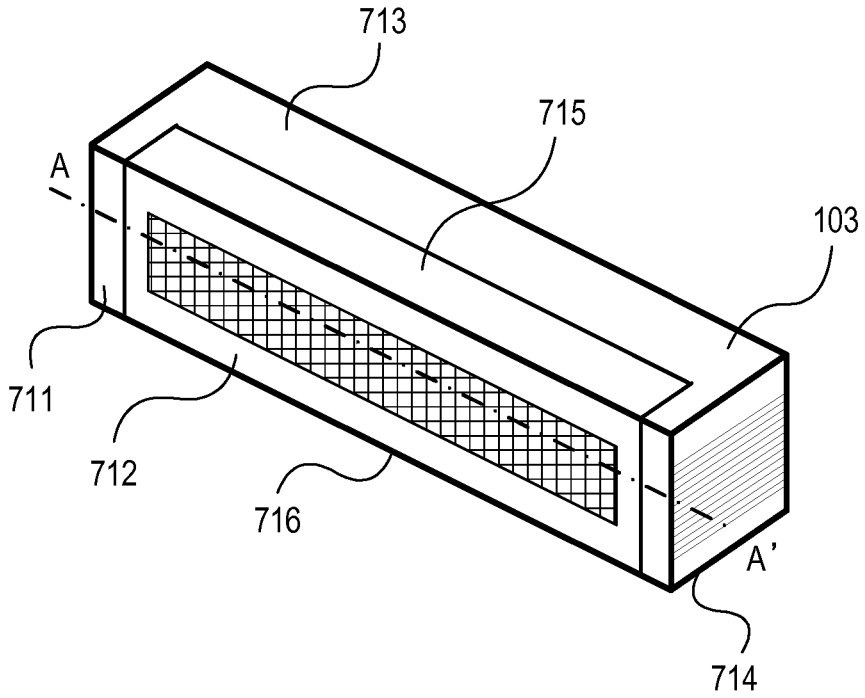
FIGS. 10A and 10B are explanatory diagrams of a method of forming a front end face electrode on the piezoelectric block.
Figure 10B:
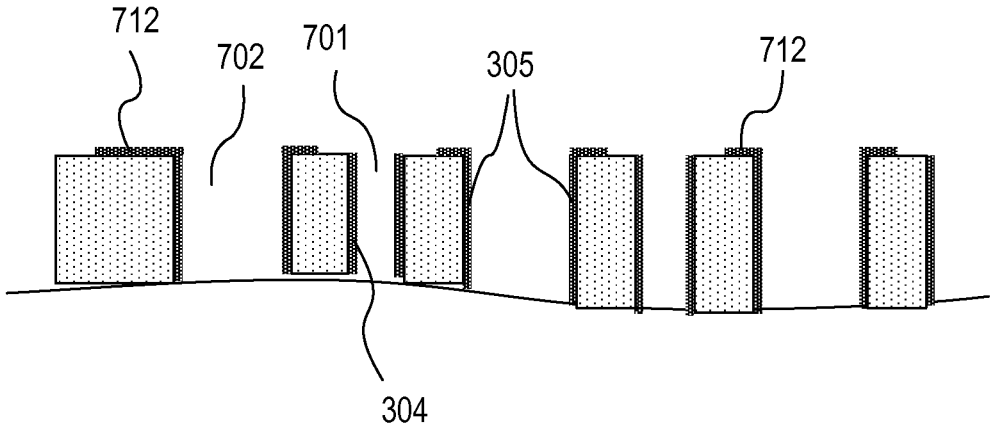

FIG. 10B is a sectional view of an electrode pattern taken along the line A-A' of FIG. 10A. The front end face electrodes 712 are electrically connected to the common electrodes 305 and 306 in the opening portions 702, respectively, but, are not electrically connected to the individual electrodes 304 and 307 in the pressure chambers 701, respectively.

(Formation of Rear End Face Electrode)

Figure 11A:
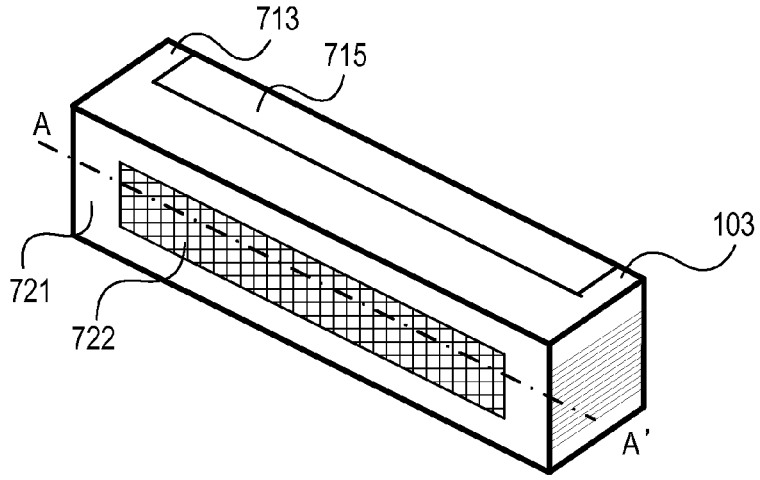
FIGS. 11A, 11B and 11C are explanatory diagrams of a method of forming a rear end face electrode on the piezoelectric block.

Then, as illustrated in FIG. 11A, rear end face electrodes 722 for leading wiring of the individual electrodes 304 and 307 provided in the pressure chambers 701 are formed on a rear end face 721 of the piezoelectric block 103. The rear end face 721 includes the pressure chambers 701, the opening portions 702, and the like, and is thus uneven. Therefore, similarly to the case of the front end face 711, an electrode pattern on the rear end face 721 is formed by lift-off using lamination of a film resist.

In patterning the electrodes, the film resist is laminated, and then, portions around the pressure chambers 701 are exposed by exposure and development. Formation of the electrodes after that is carried out similarly to the formation of the electrodes on the surfaces of the piezoelectric substrate 301 and to the formation of the front end face electrodes 712.

Figure 11B:
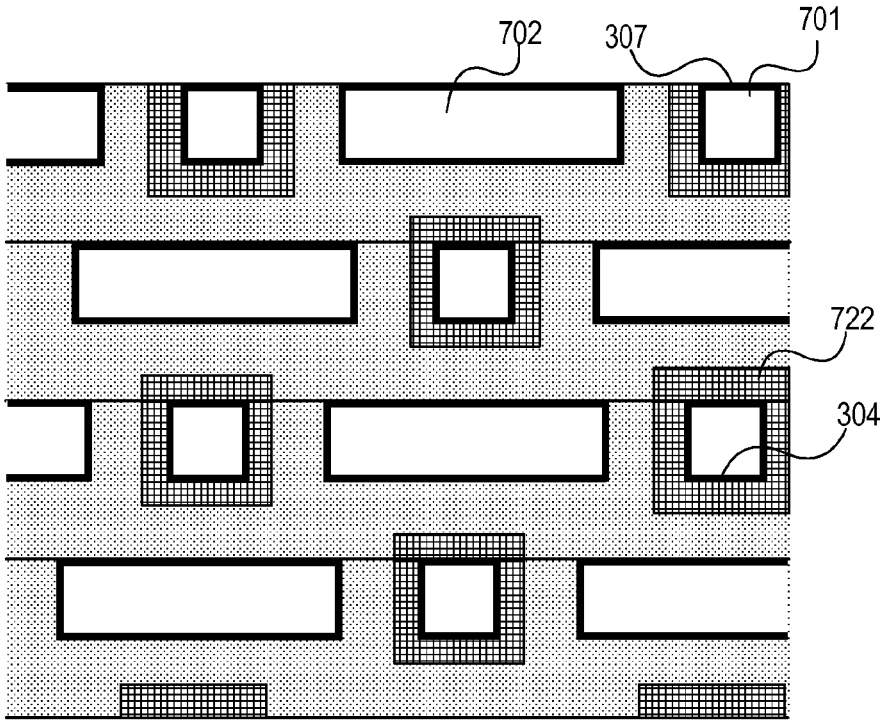
Figure 11C:
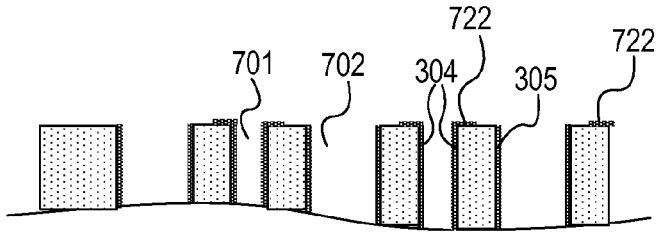

The rear end face electrodes 722 seen from the end face are in shapes illustrated in FIG. 11B, and are formed independently of one another around the ends of the respective pressure chambers 701. FIG. 11C is a sectional view taken along the line A-A' of FIG. 11A. As illustrated in the sectional view of FIG. 11C, the rear end face electrodes 722 are electrically connected to the individual electrodes 304 and 307 in the pressure chambers 701, respectively, but, are not electrically connected to the common electrodes 305 and 306 in the opening portions 702, respectively. In this way, the individual electrodes 304 and 307 formed on the inner surfaces of the respective pressure chambers 701 are electrically connected to the respective rear end face electrodes 722. Further, the individual electrodes 304 and 307 are electrically joined to respective electrodes formed on the rear throttle plate 104 so as to be led to the outside. By applying a drive signal, the pressure chambers 701 are driven independently of one another.

(Bonding of Rear Throttle Plate)

Figure 12A:
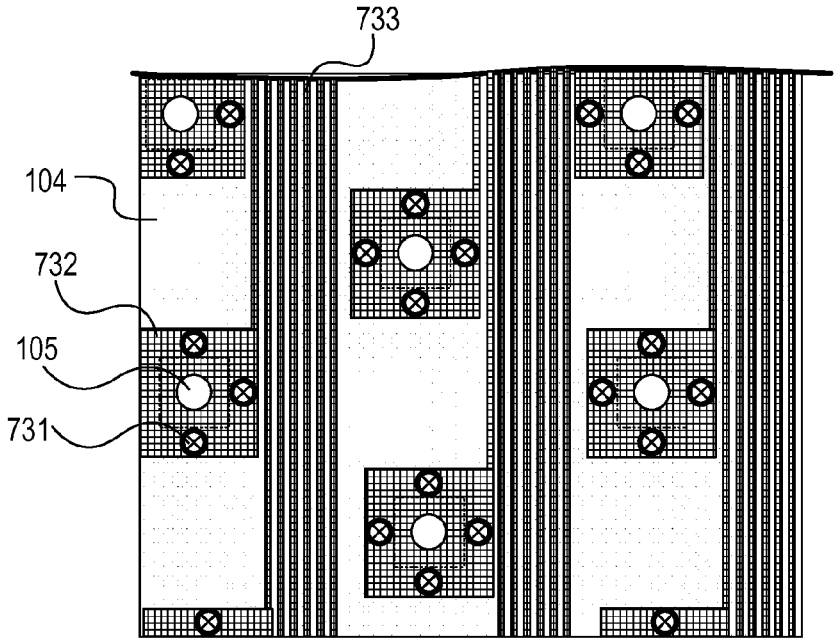
FIGS. 12A, 12B and 12C are explanatory diagrams of a method of joining a rear throttle plate to the piezoelectric block.
Figure 12B:
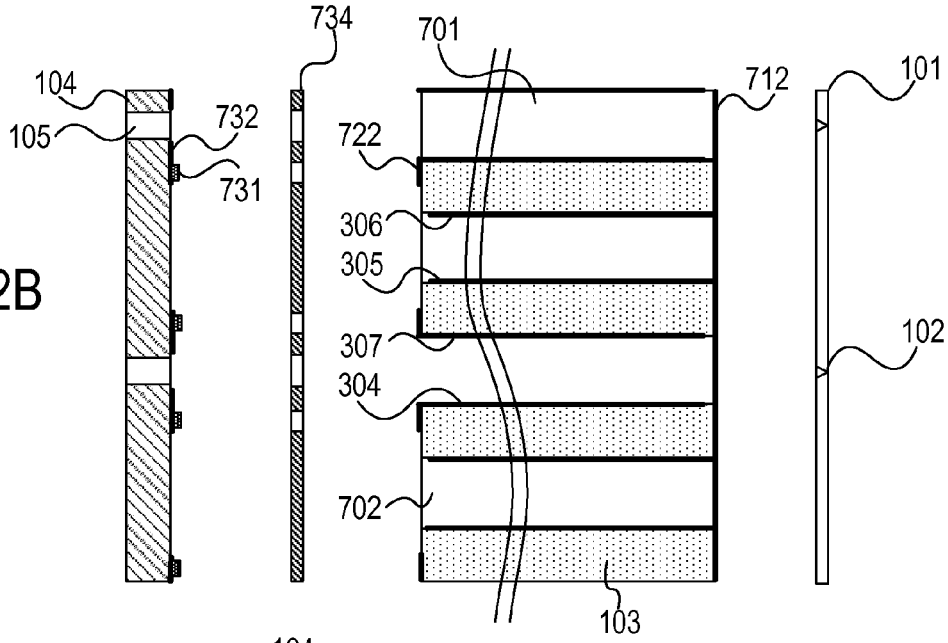
Figure 12C:
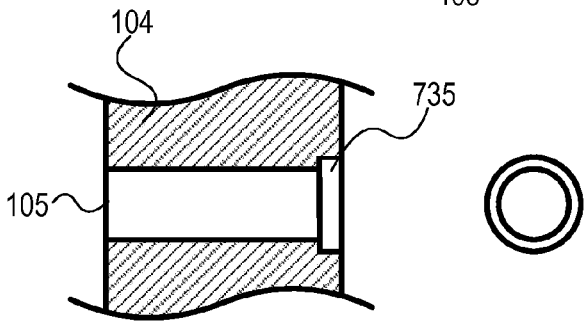

Next, the rear throttle plate 104 is described with reference to FIGS. 12A to 12C. As illustrated in FIG. 12A, the throttle holes 105 in the shape of through holes are provided in the rear throttle plate 104 at locations corresponding to the pressure chambers 701, respectively. The throttle holes 105 limit backflow of ink so that ink flow due to driving of the piezoelectric block efficiently occurs on the discharge orifice side. The rear throttle plate 104 can be formed by etching an Si substrate or the like. The throttle holes 105 are smaller than the inlet openings in the pressure chambers 701, and, for example, when the pressure chamber 701 is in the shape of a square of 120 μm×120 μm in section, the throttle holes 105 can have a diameter of about 60 μm and a thickness of about 200 μm.

Bumps 731 electrically connected to the rear end face electrodes 722 which are respectively connected to the individual electrodes 304 and 307 in the piezoelectric block 103, and electrodes 732 connected thereto are formed on a surface of the rear throttle plate 104 at locations opposed to the respective rear end face electrodes 722. Lead wirings 733 for transferring a drive voltage to the individual electrodes are formed from the electrodes 732 so as to be led separately toward an upper end or a lower end of the rear throttle plate 104. Further, the lead wirings 733 are connected to any one of the individual electrode wiring cables 110 at the upper end or the lower end. It is preferred that an insulating film be formed on portions of the rear throttle plate 104 other than portions at which the bumps 731 are formed and other than portions at which connection is made to the individual electrode wiring cables 110 for the purpose of preventing a short circuit with other electrodes on the rear end face 721 of the piezoelectric block 103 and corrosion by the liquid to be used.

Exemplary manufacture and assembly steps of the rear throttle plate 104 are now described. First, the throttle holes 105 in the shape of through holes are formed in an Si substrate as the rear throttle plate 104 by etching or the like. After that, the electrodes 732 and the lead wirings 733 are formed. Then, an insulating film is formed on the portions of the rear throttle plate 104 other than the portions at which the bumps 731 are formed and other than portions at which connection is made to the individual electrode wiring cables 110. After that, a photosensitive bonding film 734 is laminated on portions at which the rear throttle plate 104 is joined to the piezoelectric block 103. By exposure and development, portions of the photosensitive bonding film 734 which correspond to portions of the throttle holes 105 and portions of the bumps 731 are removed to form holes. FIG. 12B illustrates the photosensitive bonding film 734 in which the holes are formed. The photosensitive bonding film 734 is actually joined to the rear throttle plate 104, but, for the sake of convenience of description, the photosensitive bonding film 734 is separated from the rear throttle plate 104 in FIG. 12B. The bumps 731 are formed at predetermined locations of the rear throttle plate 104 by bonding or the like. After that, the rear throttle plate 104 and the rear end face 721 of the piezoelectric block 103 are brought into contact with each other and are pressurized while being heated to carry out bonding. The bumps 731 are collapsed to establish electrical connection with the rear end face electrodes 722. Further, portions around connecting portions between the pressure chambers 701 and the throttle holes 105 are sealed so that liquid does not leak to the outside of the joined portion.

The rear throttle plate 104 having the bumps 731 formed thereon and the piezoelectric block 103 may be bonded together also by using, for example, an epoxy-based adhesive. In this case, in order to prevent entrance of the adhesive into the throttle holes 105 in the rear throttle plate 104 and into the pressure chambers 701 in the piezoelectric block 103, it is necessary to appropriately control the amount of the adhesive. For example, by forming a thin uniform adhesive layer by spin coating or screen printing on another flat substrate, pressing the rear end face 721 of the piezoelectric block 103 against this adhesive layer, and then separating the piezoelectric block 103 from the flat substrate, a thin uniform adhesive layer can be formed on the rear end face 721. After the adhesive is applied, the rear throttle plate 104 and the piezoelectric block 103 are positioned with a small distance therebetween, and then are pressurized to be bonded to each other. The bumps 731 break through the adhesive layer to be brought into contact with the rear end face electrodes 722, and then are collapsed to be electrically connected to the rear end face electrodes 722. Further, portions around connecting portions between the pressure chambers 701 and the throttle holes 105 are sealed so that liquid does not leak to the outside of the joined portion. In order to reduce the amount of the adhesive which enters the pressure chambers 701 and the opening portions 702, it is effective to form a groove 735 outside a throttle hole 105 in the rear throttle plate 104, as illustrated in FIG. 12C, so as to be used as an escape groove for the adhesive.

(Insulation Treatment)

Next, an insulating film is formed on surfaces of the individual electrodes which are formed on the inner surfaces of the pressure chambers, and on surfaces of the common electrodes which are formed on the inner surfaces of the opening portions. However, the insulating film is not formed on portions of the electrode wiring which are to be connected to the wiring cables such as FPCs (connecting portions between the common electrode connecting portions 715 and 716 and the lead wirings 733 exposed at upper and lower ends of the rear throttle plate 104). In order to attain this, a mask is applied thereon with tape or the like when the film is formed.

As the insulating film, for example, a thin film of parylene (trademark) can be used, which can be formed by chemical vapor deposition (CVD). In particular, in order to form the insulating film on the walls even into the recesses of the pressure chambers 701, it is preferred to use parylene (N), which is excellent in throwing power. An appropriate thickness of the insulating film is about 5 μm. In order to improve the adhesion of parylene, UV ozone treatment can be applied at room temperature for about five minutes before the film is formed. Further, in order to enhance the adhesion, a coupling agent may be applied after the UV ozone treatment. In particular, when Au is used as the front end face electrodes 712 of the piezoelectric block 103, adhesion between Au and parylene is considerably low, and thus, surface treatment using a triazine thiol-based coupling agent is effective. Further, when an Si substrate is used as the rear throttle plate 104 and an oxide film is formed on the surface thereof, a silane coupling agent is effective. The coupling treatment can be applied by thinly applying the coupling agent diluted with IPA and then carrying out drying using an oven.

(Bonding of Orifice Plate)

Next, the orifice plate 101 is joined to the front end face 711 of the piezoelectric block 103. The orifice plate is joined to the piezoelectric block 103 by using, for example, an adhesive. The orifice plate 101 is in the shape of a flat plate, and has the nozzle holes 102 in the shape of through holes formed therein at locations corresponding to the respective pressure chambers 701 of the piezoelectric block 103. By way of example, the nozzle holes 102 are circular holes having a diameter of 10 μm, and the thickness of the circular holes is 20 μm. In order to prevent entrance of the adhesive into the outlet openings of the piezoelectric block 103, similarly to the case of the throttle holes 105 in the rear throttle plate 104 illustrated in FIG. 12B, escape grooves (not shown) are provided. In order to prevent accumulation of bubbles in ink, it is preferred that the escape groove in section be smaller than a pressure chamber 701 in section, and the escape groove can have, for example, a diameter of 80 μm and a thickness of 60 μm. In this case, the entire orifice plate 101 has a thickness of 80 μm. The orifice plate 101 can be prepared by, for example, electroforming Ni. Ink-repellent treatment is applied to a surface of the orifice plate 101 which is not held in contact with the front end face 711. Silane-based materials and fluorine-based materials can be used for the ink repellent material, and coating processing can be performed by vapor deposition or the like.

(Joining of FPC)

Next, the wiring cables such as FPCs are pressure-bonded to the wiring electrodes. As illustrated in FIG. 1B, individual wirings are led from the upper and lower ends of the rear throttle plate 104 so as to be pressure-bonded to the common electrode wiring cables 109. Similarly, the common electrodes are led from the upper end face 713 and the lower end face 714 of the piezoelectric block 103 so as to be pressure-bonded to the individual electrode wiring cables 110. In the compression bonding, an anisotropic conductive film (ACF) is used. As the conditions for the pressure bonding, 150° C., 3 MPa, and about 10 seconds are appropriate. After the pressure bonding, portions around the portions joined to the FPCs are reinforced with an adhesive.

(Bonding of Common Liquid Chamber)

After that, the common liquid chamber 106 having the ink supply port 108 is prepared and is joined to the rear throttle plate 104. Material of the common liquid chamber is made from, for example, a SUS substrate formed by machining and is joined to the rear throttle plate with an adhesive. Lastly, other necessary components are assembled to complete the liquid discharge head.

(Liquid Discharge Driving)

Figure 13:
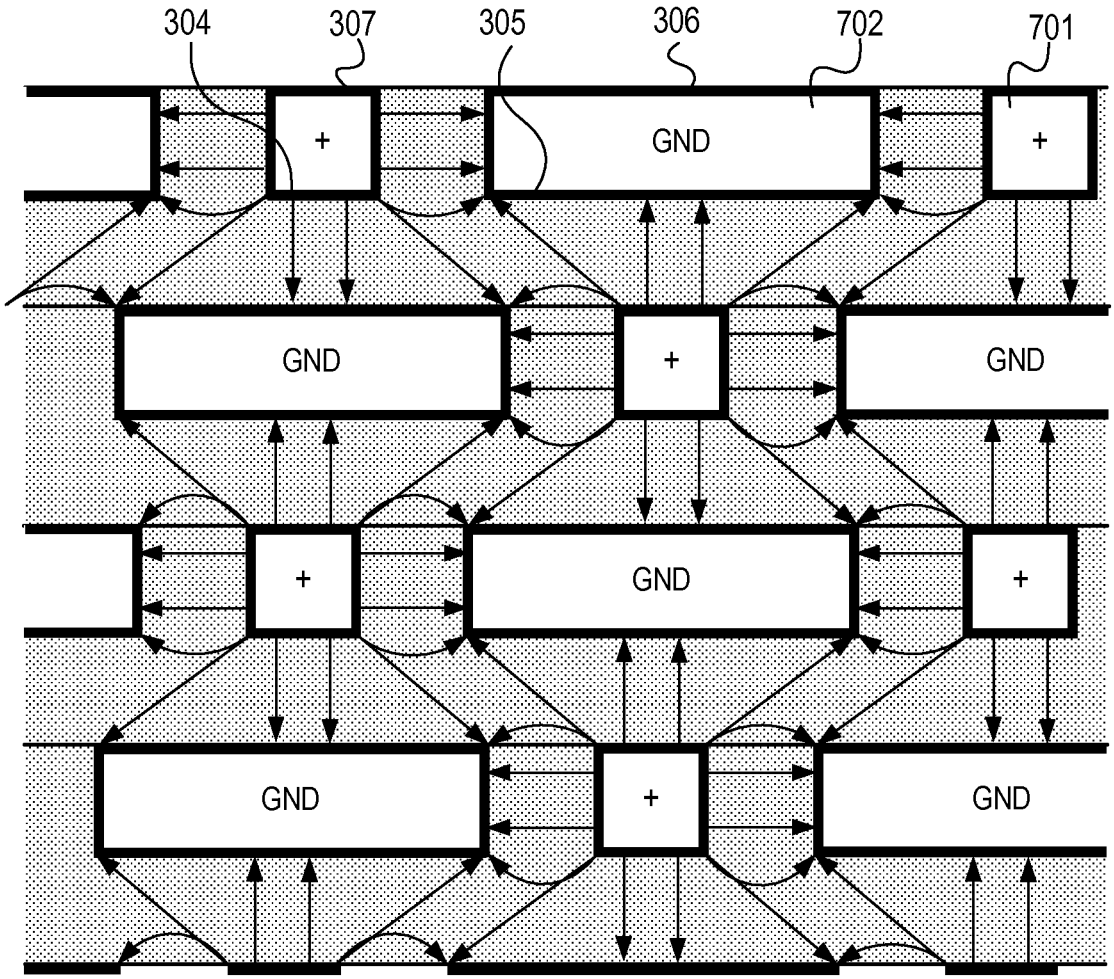
FIG. 13 is an electric field distribution when voltage in discharging liquid is applied to the piezoelectric block.

The liquid is supplied from the inlet opening in the pressure chamber 701 of the piezoelectric block 103 to the pressure chamber, and is stored in the pressure chamber. Deformation of the piezoelectric block by the piezoelectric effect shrinks the pressure chamber to discharge through the outlet opening the liquid stored in the pressure chamber. FIG. 13 illustrates an electric field distribution when a drive voltage for discharging the liquid is applied to the individual electrodes of all the pressure chambers 701. In this case, a positive voltage is applied to the individual electrodes of the pressure chambers 701. The mark "+" in the pressure chambers 701 represents that a positive drive voltage is applied to the individual electrodes 304 and 307 in the pressure chambers 701. Similarly, "GND" in the opening portions 702 represents that a ground potential of 0 V is applied to the common electrodes 305 and 306 in the opening portions 701.

An electric field having the same distribution as that in the polarization illustrated in FIG. 6B is applied to the piezoelectric bodies around the pressure chambers 701. The piezoelectric bodies expand in a direction in parallel with the electric field, and shrink in a direction orthogonal to the electric field. Therefore, the cross-sectional areas of the pressure chambers 701 become smaller and the pressure of the liquid filled in the pressure chambers 701 becomes higher to cause the liquid to be discharged through the nozzle holes 102.

In the liquid discharge head having the dimensions of this embodiment, by discharging the liquid while a recording medium is transferred in the direction in which the piezoelectric bodies are stacked, an image having a resolution of 1,200 dpi can be formed.

In the piezoelectric block 103 described in this embodiment, the side walls of the pressure chamber 701 and the piezoelectric bodies on both sides thereof in the piezoelectric substrate 301 are within the opening portions 702 in the piezoelectric substrates 301 vertically adjacent to the piezoelectric substrate 301 (W1+W2+W3<W4). Therefore, deformation of piezoelectric bodies around the pressure chamber 701 is less liable to be prevented by the voltage applied to an individual electrode in an adjacent pressure chamber 701. Further, the piezoelectric bodies on the upper, lower, right, and left sides of a pressure chamber 701 are displaced, and thus, a liquid discharge head having strong discharge force can be formed. Further, the pressure chambers 701 are connected to opening portions 702 therearound via piezoelectric bodies. Specifically, four independent opening portions 702 are provided around a pressure chamber 701, and space between the pressure chamber 701 and the opening portions 702 is filled with the piezoelectric substrates (piezoelectric material). Therefore, the stiffness of the piezoelectric block 103, in particular, of portions around the pressure chambers 701 can be enhanced.

(Second Embodiment)

In this embodiment, the intervals of the first grooves 302 which form the pressure chambers in the piezoelectric substrates 301 are reduced to be smaller than those in the first embodiment, which is n=25, the number of the piezoelectric substrates to be stacked is reduced to be 27, and a piezoelectric block 103 having the same resolution as in the first embodiment, which is 1,200 dpi, is formed.

Figure 14A:
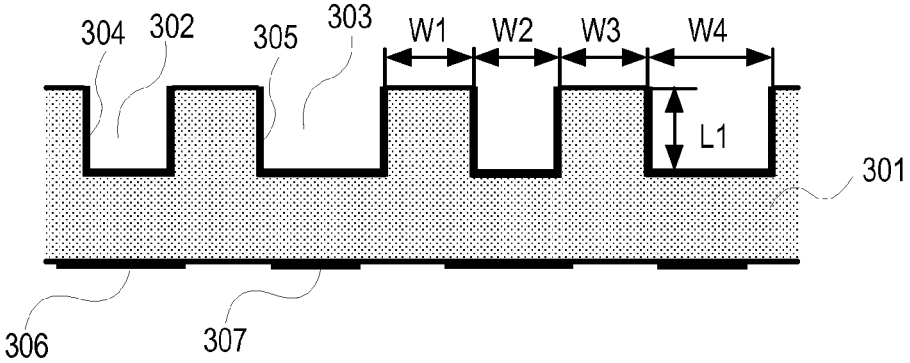
FIGS. 14A, 14B and 14C illustrate a piezoelectric substrate according to a second embodiment of the present invention and a piezoelectric block in which the piezoelectric substrates are stacked.
Figure 14B:
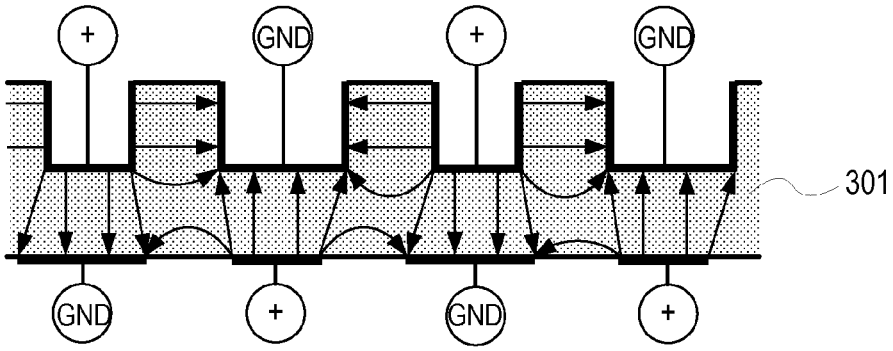
Figure 14C:
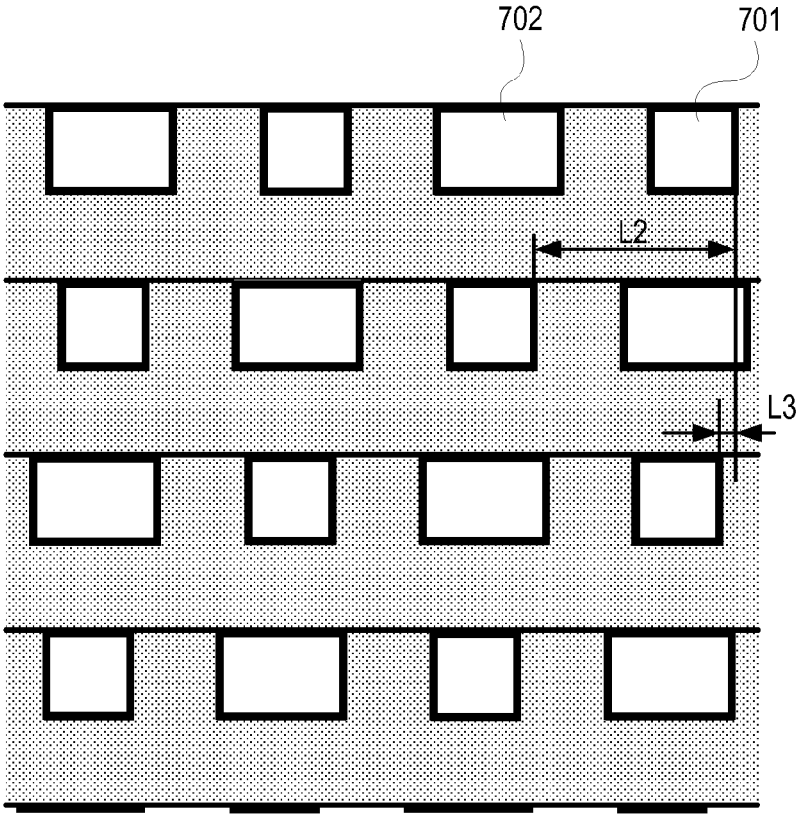

FIGS. 14A to 14C illustrate a structure of the piezoelectric substrate 301 which forms the piezoelectric block 103. FIG. 14A illustrates dimensions of portions of the piezoelectric substrate 301 according to this embodiment. The thickness of the piezoelectric substrate is about 0.24 mm, and the depth L1 of the grooves, the width W2 of the first grooves 302 forming the pressure chambers, and the thicknesses W1 and W3 of the side walls of the pressure chambers are all 0.12 mm. The width W4 of the second grooves 303 forming the opening portions is calculated as W432 0.0212×25−W1−W2−W332 0.17 mm.

The polarization treatment is performed by, as illustrated in FIG. 14B, applying a voltage to the piezoelectric substrate 301. The method of applying the voltage and the conditions of the voltage application are the same as those in the first embodiment. The piezoelectric substrates 301 after the polarization treatment are bonded together using an epoxy-based adhesive or the like. 27 piezoelectric substrates 301 are stacked to form the piezoelectric block 103. FIG. 14C illustrates the positional relationship between the pressure chambers 701 and the opening portions 702 in the piezoelectric block 103 and the dimensions thereof. When the resolution is 1,200 dpi, L2=21.2×13=275.6 μm, and L3=21.2 μm. The method of forming the pressure chambers 701 and the opening portions 702 and the relationship of the pressure chambers 701 and the opening portions 702 with the electrodes are similar to those in the first embodiment.

Figure 15A:
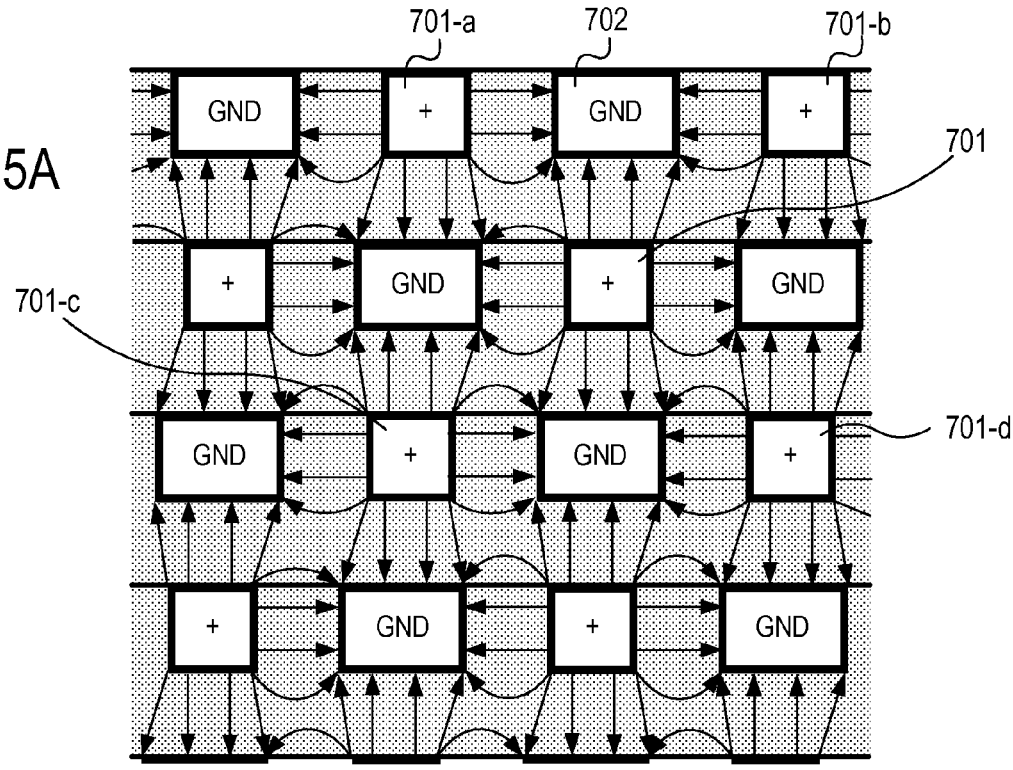
FIGS. 15A and 15B are electric field distributions when voltage in discharging liquid is applied to the piezoelectric block.

FIG. 15A illustrates an electric field distribution when a positive drive voltage for discharging liquid is applied to the individual electrodes of all the pressure chambers 701. An electric field having the same distribution as that in the polarization illustrated in FIG. 6B is applied to the piezoelectric bodies around the pressure chambers 701, and the cross-sectional areas of the pressure chambers 701 become smaller.

Figure 15B:
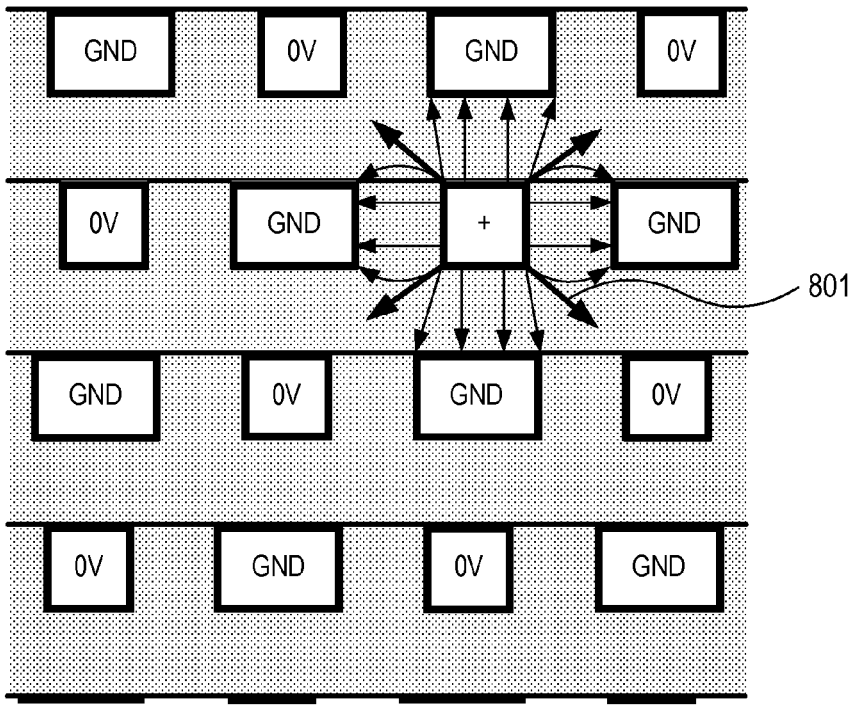

In the piezoelectric block 103 of this embodiment, the location of the pressure chamber 701 in the piezoelectric substrate 301 in a width direction is within the widths of the opening portions 702 in the piezoelectric substrates 301 vertically adjacent to the piezoelectric substrate 301. However, the side walls of the piezoelectric bodies on both sides of the pressure chamber 701 overlap only part of the piezoelectric bodies on both sides of the pressure chambers 701 formed in the piezoelectric substrates 301 vertically adjacent to the piezoelectric substrate 301 (W1+W2+W3>W4). Therefore, mechanical and electrical crosstalk may be caused between, for example, the pressure chamber 701 and other four pressure chambers (701-*a*, 701-*b*, 701-*c*, and 701-*d*) which are formed in the piezoelectric substrates 301 vertically adjacent to the piezoelectric substrate 301 and which are diagonal to the pressure chamber 701. Specifically, FIG. 15B illustrates an electric field distribution when a positive drive voltage is applied only to the individual electrode of one pressure chamber 701. The individual electrodes in the four pressure chambers 701-*a*, 701-*b*, 701-*c*, and 701-*d* diagonal to the pressure chamber 701 have the ground potential of 0 V, and thus, a potential difference is caused with these pressure chambers to cause an electric field. Thick arrows 801 of FIG. 15B indicate this electric field expressed by electric flux. On the other hand, in FIG. 15A, the same positive potential is applied to the pressure chamber 701 and the four pressure chambers 701-*a*, 701-*b*, 701-*c*, and 701-*d*, and thus, no electric field is caused and no electric flux indicated by the arrows 801 appears.

In this way, the electric field in orthogonal directions caused around corners of the pressure chamber 701 differs between a case in which discharge is made through all the nozzles and a case in which discharge is made through one nozzle. However, as illustrated in the electric field distribution in the polarization of FIG. 6B, in the polarization, no potential difference is caused in the orthogonal directions and no electric field is caused, and thus, the piezoelectric bodies are not polarized in the orthogonal directions. Therefore, even when the electric field changes between a case in which discharge is made through all the nozzles and a case in which discharge is made through one nozzle, the way in which the pressure chambers 701 deform does not change much, and, when the intervals of the pressure chambers 701 are reduced as in this embodiment, crosstalk is more liable to occur, but the liquid discharge characteristics do not change much.

Next, a driving method for reducing the above-mentioned crosstalk for the purpose of further inhibiting the effect on the liquid discharge characteristics is described. As described above, when a positive drive voltage is applied to the individual electrode in the pressure chamber 701, the voltage of the individual electrodes in the other four pressure chambers 701 that are diagonal to the pressure chamber 701 and are formed in the piezoelectric substrates 301 vertically adjacent to the piezoelectric substrate 301 takes on any one of a positive voltage or 0 V, and thus, crosstalk is caused. Accordingly, in order to reduce crosstalk, the pressure chambers are driven so that the voltages of the individual electrodes in the other four pressure chambers 701 diagonal to the pressure chamber 701 are always 0 V. Specifically, when the piezoelectric block is driven, a first potential is applied to the first in-groove electrodes and the first rear surface electrodes of the piezoelectric substrate so that a positive potential and the ground potential are periodically repeated. A second potential is applied to the first in-groove electrodes and the first rear surface electrodes of the piezoelectric substrates vertically adjacent to the piezoelectric substrate so that a positive potential and the ground potential are periodically repeated. In this case, when the first potential is a positive potential, the second potential is adapted to be the ground potential, and, when the first potential is the ground potential, the second potential is adapted to be a positive potential.

Figure 16A:
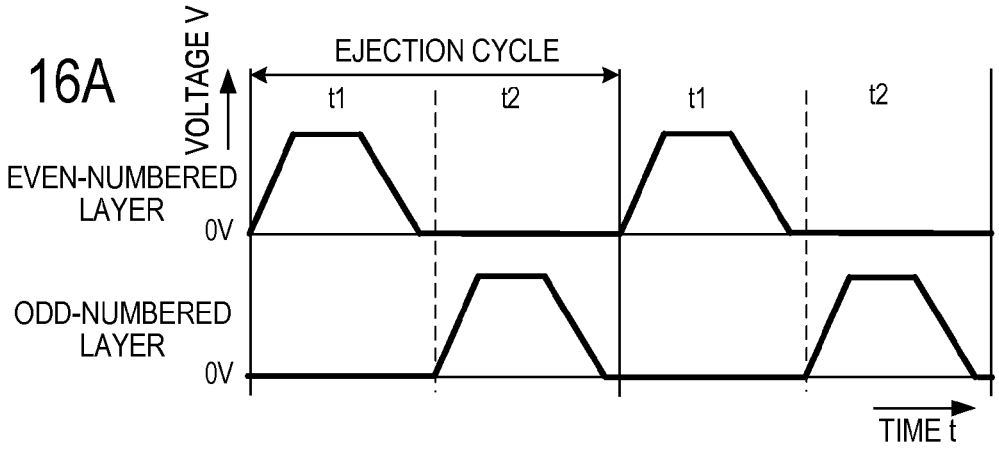
FIGS. 16A, 16B and 16C are explanatory diagrams of a driving method for reducing crosstalk.
Figure 16B:
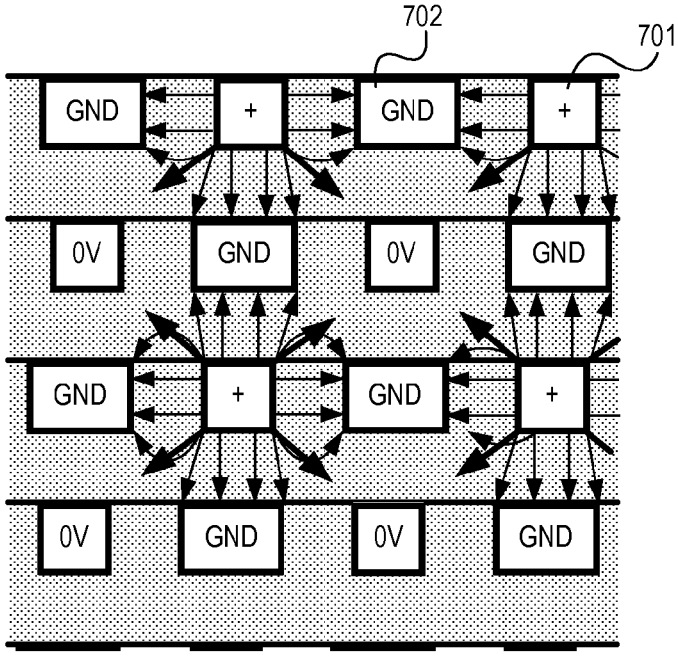
Figure 16C:
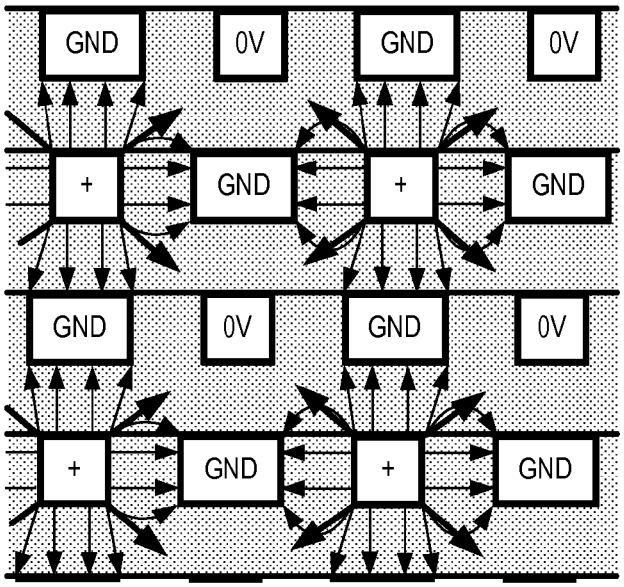

More specifically, as illustrated in FIG. 16A, the discharge cycle is divided into two. In a former half of the discharge cycle, that is, a discharge cycle t1, the individual electrodes in the pressure chambers 701 in even-numbered layers are driven, and, in a latter half of the discharge cycle, that is, a discharge cycle t2, the individual electrodes in the pressure chambers 701 in odd-numbered layers are driven. This causes, even when discharge is made through all the nozzles, an electric field as illustrated in FIG. 16B in the discharge cycle t1, and an electric field as illustrated in FIG. 16C in the discharge cycle t2. With regard to both FIGS. 16A and 16B, the electric field distribution around one pressure chamber 701 is the same as the electric field distribution illustrated in FIG. 15B in a case in which discharge is made through one nozzle. Therefore, even when the number of discharge nozzles changes, the way in which the pressure chambers 701 deform is the same, and the discharge characteristics do not change. In this driving method, the piezoelectric bodies around the other four pressure chambers 701 that are diagonal to the pressure chamber 701 in which a positive drive voltage is applied to the individual electrode thereof, and that are formed in the piezoelectric substrates 301 vertically adjacent to the piezoelectric substrate 301 are not displaced at the same time, and thus, mechanical crosstalk is not caused therefrom.

In the case where, as in this embodiment, an image is formed while a recording medium is transferred in the stack direction of the piezoelectric bodies in a liquid discharge head in which the nozzle holes 102 are staggered and two-dimensionally arranged, when all the nozzle holes 102 are driven at the same timing, it is preferred that the nozzle pitches in the stack direction be an integral multiple of the resolution. In this embodiment, the image resolution which is the recording dot grid dimension is 1,200 dpi and the thickness of the piezoelectric substrate 301 is about 0.24 mm. The recording dot grid dimension corresponding to the resolution of 1,200 dpi is 0.0212 mm. Therefore, it is preferred to, by adjusting the thicknesses of the piezoelectric substrate 301 and the adhesive, set the nozzle pitches to be 0.2332 mm which is 0.0212 mm multiplied by 11, or to be 0.2544 mm which is 0.0212 mm multiplied by 12.

On the other hand, when, as in this embodiment, the discharge cycle is divided into two and the liquid is discharged alternately through the nozzle holes 102 in the even-numbered layers and the nozzle holes 102 in the odd-numbered layers to form an image, it is preferred that the nozzle pitches L be as follows:

$$L=P\times(k+1/m)=0.0212\times(k+1/2)\text{ mm},$$

where P is the recording dot grid dimension, k is an arbitrary natural number determined in accordance with the design and the manufacturing method, and m is the number of the divisions.

The thickness of the piezoelectric substrate 301 is about 0.24 mm. When k=11 holds, it is preferred that the nozzle pitches are 0.2438 mm.

As a driving method for reducing crosstalk, an embodiment is described in which the discharge cycle is divided into two, but, insofar as the other four pressure chambers 701 that are diagonal to the driven pressure chamber 701 and are formed in the piezoelectric substrates 301 vertically adjacent to the piezoelectric substrate 301 in which the driven pressure chamber 701 is formed are not driven at the same time, the number of the divisions may be larger, for example, three or four.

In this embodiment, n=25 holds so that the dimension of a pressure chamber 701 in a piezoelectric substrate 301 is within the dimensions of the opening portions 702 of the piezoelectric substrates 301 vertically adjacent to the piezoelectric substrate 301. When the width of the opening portion 702 is caused to be further smaller, the amount of the deformation is slightly reduced to reduce the discharge force, but, insofar as the function as the liquid discharge head is ensured, a structure in which the number of the stacked piezoelectric substrates is further reduced to downsize the piezoelectric block 103 is also possible.

(Third Embodiment)

A polarizing method and a driving method for improving the discharge characteristics of the piezoelectric block 103 described in the first and second embodiments are described.

In the first and second embodiments, the same polarization treatment is applied to all the piezoelectric substrates 301 having the grooves machined therein and having the electrodes formed thereon and the piezoelectric substrates 301 are stacked. In the polarization treatment, as illustrated in FIGS. 6B and 14B, the same positive voltage is applied to the individual electrodes 304 and 307, and thus, there is no potential difference in a linear region which connects the electrodes 304 and 307 and no electric field is caused, and thus, the region is not polarized. Therefore, the four corners of a pressure chamber 701 formed by stacking piezoelectric substrates 301 are not polarized. This has an effect of reducing crosstalk caused by driving/non-driving of the other four pressure chambers 701 diagonal to the pressure chamber 701, but the discharge force is reduced by the nondeformation of these portions when the drive voltage is applied.

In order to also polarize these portions so as to be deformed by the drive voltage to increase the discharge force, the direction of the polarization of the stacked piezoelectric substrates 301 can be alternately changed to change the polarity of the drive voltage accordingly. Specifically, in this embodiment, when the piezoelectric block is driven, a first potential is applied to the first in-groove electrodes and the first rear surface electrodes of a first piezoelectric substrate so that a positive potential and the ground potential are periodically repeated. A second potential is applied to the first in-groove electrodes and the first rear surface electrodes of a second piezoelectric substrate so that a negative potential and the ground potential are periodically repeated. In this case, when the first potential is a positive potential, the second potential is adapted to be the ground potential, and, when the first potential is the ground potential, the second potential is adapted to be a negative potential.

Figure 17A:
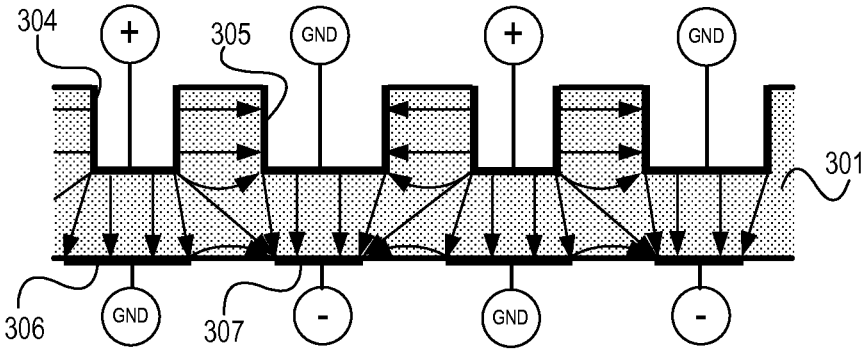
FIGS. 17A, 17B and 17C are explanatory diagrams of a method of polarizing a piezoelectric substrate according to a third embodiment of the present invention and electric field distributions when voltage is applied thereto.
Figure 17B:
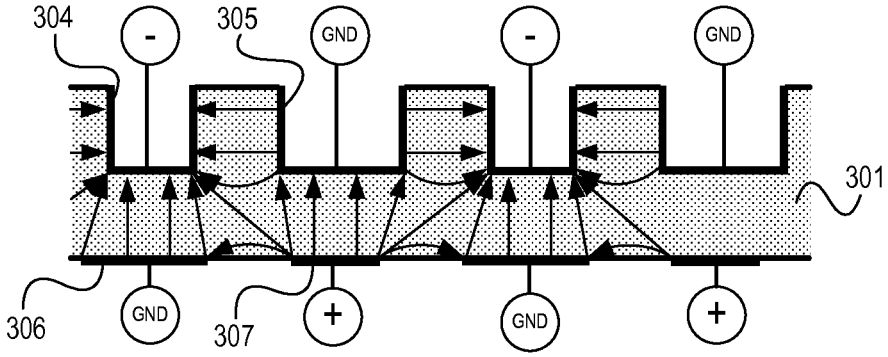

For example, with regard to the piezoelectric substrates 301 used in the even-numbered layers, as illustrated in FIG. 17A, the polarization treatment is performed as follows. A positive voltage is applied to the individual electrodes 304, the common electrodes 305 and 306 are at the ground potential, and a negative voltage is applied to the individual electrodes 307. With regard to the piezoelectric substrates 301 used in the odd-numbered layers, as illustrated in FIG. 17B, the polarization treatment is performed as follows. A negative voltage is applied to the individual electrodes 304, the common electrodes 305 and 306 are at the ground potential, and a positive voltage is applied to the individual electrodes 307. By performing the polarization treatment in this way, potential difference can be caused also in a linear region which connects the individual electrodes 304 and 307, an electric field is caused, and the polarization is carried out.

Figure 17C:
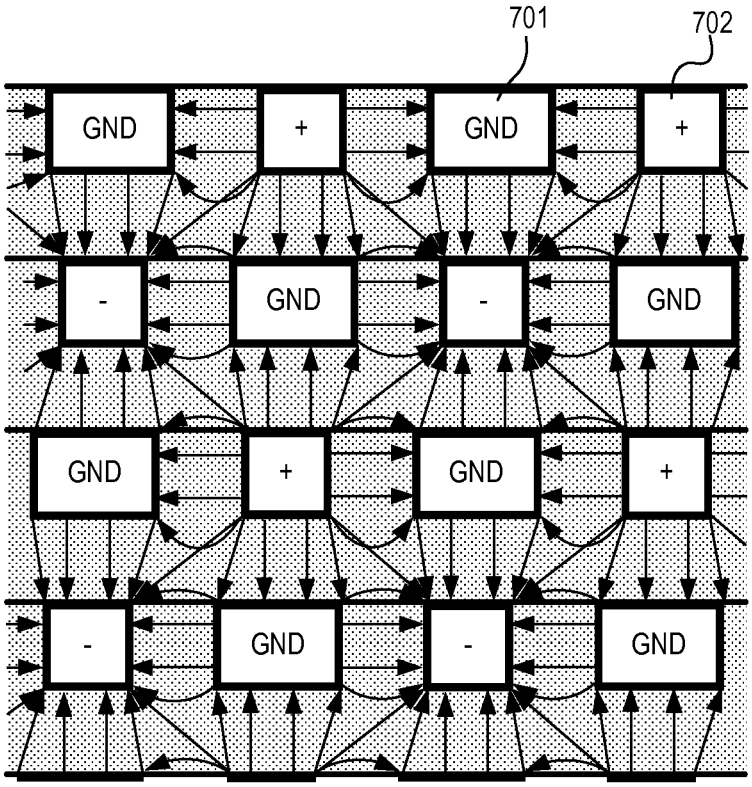

FIG. 17C illustrates an electric field distribution when the piezoelectric substrates 301 are stacked, the individual electrodes of all the pressure chambers 701 in the even-numbered layers are driven by a positive voltage, and the individual electrodes of all the pressure chambers 701 in the odd-numbered layers are driven by a negative voltage. In this case, the electric field distribution is the same as that in the polarization. The piezoelectric bodies around the four corners of a pressure chamber 701 are also polarized, and an electric field which is the same as that in the polarization is applied thereto, and thus, the piezoelectric bodies are deformed to increase the force for shrinking the pressure chamber 701. Therefore, the discharge force increases.

Figure 18A:
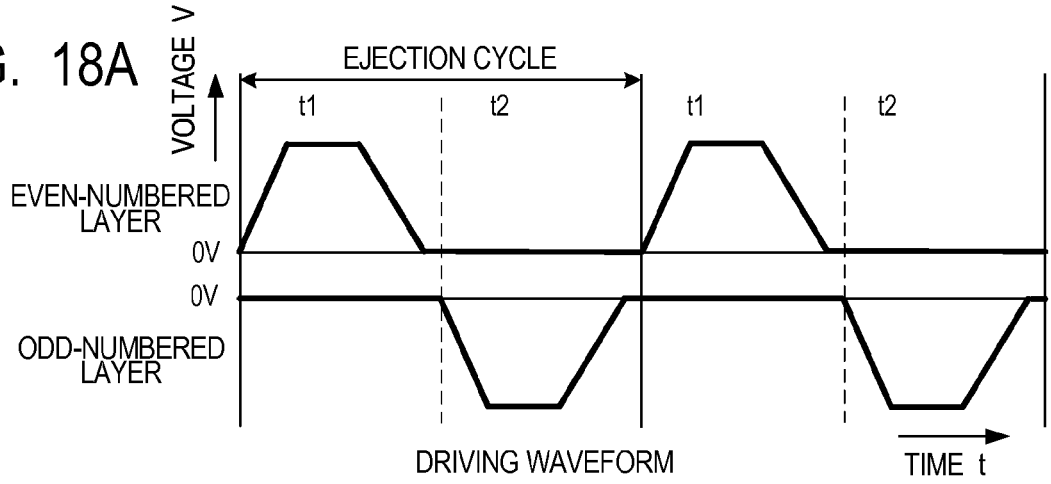
FIGS. 18A, 18B and 18C are explanatory diagrams of a driving method according to the third embodiment and electric field distributions in driving.
Figure 18B:
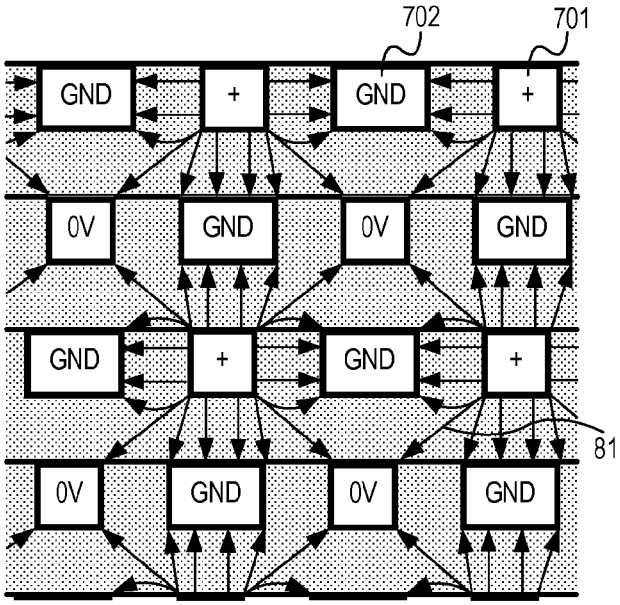
Figure 18C:
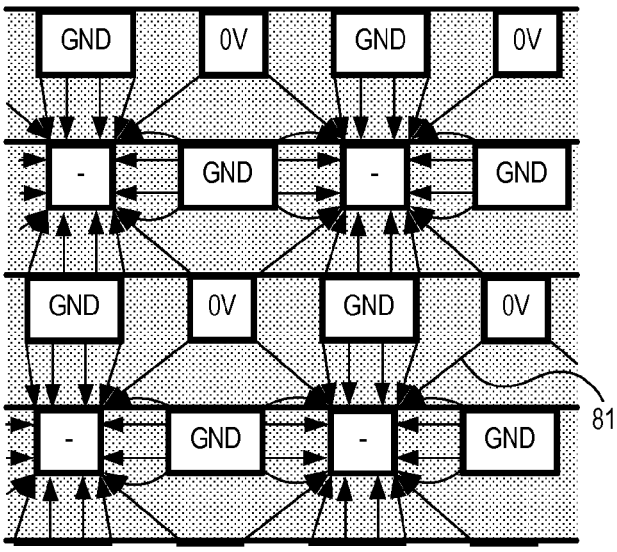

However, when, depending on driving/non-driving of the other four pressure chambers 701 diagonal to the pressure chamber 701, the voltage applied between the pressure chambers changes, the electric field caused between the pressure chambers change to cause crosstalk. In order to prevent the crosstalk from being caused, time-sharing driving as illustrated in FIG. 18A is carried out. The discharge cycle is divided into two. In the former half of the discharge cycle, that is, the discharge cycle t1, the individual electrodes in the pressure chambers 701 in the even-numbered layers are driven by a positive voltage, and, in the latter half of the discharge cycle, that is, the discharge cycle t2, the individual electrodes in the pressure chambers 701 in the odd-numbered layers are driven by a negative voltage. This causes an electric field as illustrated in FIG. 18B in the discharge cycle t1, and an electric field as illustrated in FIG. 18C in the discharge cycle t2. The piezoelectric bodies around the four corners of the pressure chamber 701 are also polarized, and electric flux denoted by arrows 81 appears in these portions, and thus, the piezoelectric bodies are deformed to increase the force for shrinking the pressure chamber 701. Therefore, the discharge force increases. As illustrated in FIGS. 18B and 18C, the individual electrodes in the other four pressure chambers 701 diagonal to the driven pressure chamber 701 are always at 0 V, and the electric field distribution is not changed depending on the discharge pattern, and thus, no crosstalk is caused.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-140701, filed Jun. 22, 2012 which is hereby incorporated by reference herein in its entirety.

What is claimed is:

1. A liquid discharge head, comprising a piezoelectric block formed by stacking multiple piezoelectric substrates, each of the multiple piezoelectric substrates including a first main surface and a second main surface and having a first groove and a second groove alternately formed in the first main surface, wherein the each of the multiple piezoelectric substrates includes a first in-groove electrode on an inner surface of the first groove, a first rear surface electrode on the second main surface at a location corresponding to the second groove, a second in-groove electrode on an inner surface of the second groove, and a second rear surface electrode on the second main surface at a location corresponding to the first groove, the first rear surface electrode being defined at the same potential as a potential of the first in-groove electrode, the second rear surface electrode being defined at the same potential as a potential of the second in-groove electrode, and wherein the first groove forms a pressure chamber having the first in-groove electrode and the first rear surface electrode formed on the inner surface thereof, the pressure chamber including an inlet opening and an outlet opening of liquid and being configured to store the liquid supplied from the inlet opening and discharge the liquid through the outlet opening by deformation of the piezoelectric block by piezoelectric effect, and the second groove forms an opening portion having the second in-groove electrode and the second rear surface electrode formed on the inner surface thereof.

2. A liquid discharge head according to claim 1, wherein a width of the first groove, a width of the second groove, and a width of a side wall that separates the first groove and the second groove are the same.

3. A liquid discharge head according to claim 1, wherein the piezoelectric block is polarized in a direction that passes through the pressure chamber and the opening portion around the pressure chamber.

4. A liquid discharge head according to claim 1, wherein, when the piezoelectric block is driven, a first potential is applied to the first in-groove electrodes and the first rear surface electrodes of one of the multiple piezoelectric substrates so that a positive potential and a ground potential are periodically repeated, and a second potential is applied to the first in-groove electrodes and the first rear surface electrodes of another one of the multiple piezoelectric substrates adjacent to the one piezoelectric substrate so that a positive potential and a ground potential are periodically repeated, the second potential being the ground potential when the first potential is a positive potential, the second potential being a positive potential when the first potential is the ground potential.

5. A liquid discharge head according to claim 1, wherein the multiple piezoelectric substrates comprise a first piezoelectric substrate and a second piezoelectric substrate that are alternately stacked, the first piezoelectric substrate being a piezoelectric substrate and being polarized by applying a positive potential to the first in-groove electrode and applying a negative potential to the first rear surface electrode with the second in-groove electrode and the second rear surface electrode being at the ground potential, the second piezoelectric substrate being a piezoelectric substrate and being polarized by applying a negative potential to the first in-groove electrode and applying a positive potential to the first rear surface electrode with the second in-groove electrode and the second rear surface electrode being at the ground potential.

6. A liquid discharge head according to claim 5, wherein, when the piezoelectric block is driven, a first potential is applied to the first in-groove electrodes and the first rear surface electrodes of the first piezoelectric substrate so that a positive potential and a ground potential are periodically repeated, and a second potential is applied to the first in-groove electrodes and the first rear surface electrodes of the second piezoelectric substrate so that a negative potential and the ground potential are periodically repeated, the second potential being the ground potential when the first potential is a positive potential and the second potential being a negative potential when the first potential is the ground potential.

* * * * *